US008187782B2

(12) United States Patent
Fujisaki et al.

(10) Patent No.: US 8,187,782 B2
(45) Date of Patent: May 29, 2012

(54) FULL COLOR IMAGE FORMATION PROCESS

(75) Inventors: Tatsuya Fujisaki, Tokyo (JP); Mikio Kouyama, Tokyo (JP); Kenji Hayashi, Tokyo (JP); Hiroyuki Yasukawa, Tokyo (JP); Natsuko Kusaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 403 days.

(21) Appl. No.: 12/465,017

(22) Filed: May 13, 2009

(65) Prior Publication Data

US 2009/0291375 A1 Nov. 26, 2009

(30) Foreign Application Priority Data

May 22, 2008 (JP) ..... 2008-134056

(51) Int. Cl.
*G03G 13/08* (2006.01)

(52) U.S. Cl. ..... 430/123.57; 430/45.5; 430/123.5

(58) Field of Classification Search ..... 430/45.5, 430/123.5, 123.57
See application file for complete search history.

(56) References Cited

U.S. PATENT DOCUMENTS

| | | | | |
|---|---|---|---|---|
| 7,767,370 | B2 * | 8/2010 | Ishigami et al. | 430/45.51 |
| 2008/0113284 | A1 * | 5/2008 | Hayashi et al. | 430/45.5 |
| 2008/0247788 | A1 * | 10/2008 | Ayaki et al. | 399/321 |
| 2009/0291376 | A1 * | 11/2009 | Hirano et al. | 430/97 |

FOREIGN PATENT DOCUMENTS

JP 2009-075520 * 4/2009

OTHER PUBLICATIONS

Diamond, "Handbook of Imaging Materials," 2nd ed., Marcel Dekker, NY, NY 2001 pp. 145-164.*
Translation of JP 2009-075520 published Apr. 2009.*
* cited by examiner

*Primary Examiner* — Peter Vajda
(74) *Attorney, Agent, or Firm* — Lucas & Mercanti, LLP

(57) ABSTRACT

Disclosed is a process of forming a full color image according to electrophotography, employing a yellow toner, a magenta toner and a cyan colorant, the process comprising the step of forming a yellow toner image, a magenta toner image and a cyan toner image on a recording material, wherein the yellow toner image has reflectance (in terms of %) satisfying formulas (11) through (14) below, the magenta toner image has reflectance (in terms of %) satisfying formulas (21) through (24) below, and the cyan toner image has reflectance (in terms of %) satisfying formulas (31) through (34) below.

$2 \leqq A_{415}+A_{460} \leqq 24$ Formula (11)

$20 \leqq A_{510}-A_{490} \leqq 40$ Formula (12)

$2 \leqq A_{550}-A_{530} \leqq 16$ and Formula (13)

$70 \leqq A_{550}$ Formula (14)

$30 \leqq B_{450}-B_{520} \leqq 85$ Formula (21)

$1 \leqq B_{530}+B_{570} \leqq 25$ Formula (22)

$2 \leqq B_{670}-B_{600} \leqq 50$ and Formula (23)

$80 \leqq B_{670}$ Formula (24)

$4 \leqq |C_{480}-C_{450}| \leqq 16$ Formula (31)

$15 \leqq C_{550}-C_{570} \leqq 35$ and Formula (32)

$20 \leqq C_{570} \leqq 50$ Formula (33)

$0 \leqq C_{620}+C_{650} \leqq 30$ Formula (34)

9 Claims, 1 Drawing Sheet

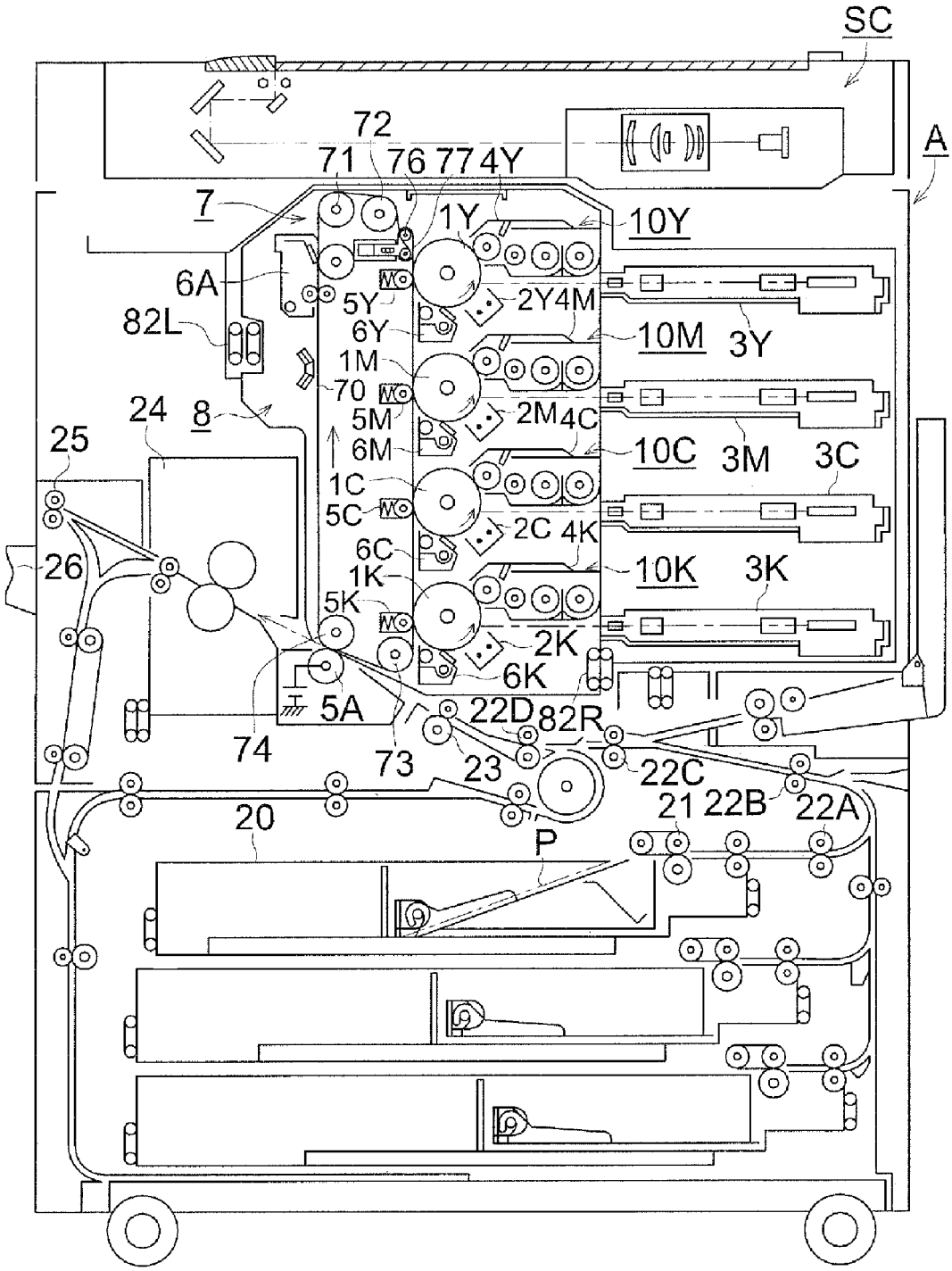
SC
A
72
71
76
77
4Y
7
1Y
10Y
6A
5Y
2Y
4M
82L
6Y
10M
3Y
1M
70
5M
2M
4C
24
8
25
6M
10C
3M
3C
1C
5C
2C
4K
26
6C
1K
10K
3K
5K
2K
6K
5A
22D
82R
74
73
23
22C
21
22B
22A
20
P

FULL COLOR IMAGE FORMATION PROCESS

This application is based on Japanese Patent Application No. 2008-134056, filed on May 22, 2008 in Japanese Patent Office, the entire content of which is hereby incorporated by reference.

FIELD OF THE INVENTION

The present invention relates to a full color image formation process according to electrophotography.

BACKGROUND OF THE INVENTION

A color image formation apparatus employing an electrophotographic method has been applied not only to office use such as color printers or color copiers, but also to commercial printing fields which are called desk-top publishing (DTP) and on-demand publishing. In the commercial printing fields, the color image formation apparatus employing an electrophotographic method is suitably used as a pre-press apparatus which is employed in the preparatory stages to prepare plates for mass-printing or an apparatus which can perform quick printing of a small lot such as several thousand prints to several ten thousand prints.

In the commercial printing field including a color image, most of corporate colors or colors of logo-marks, trade narks and products do not fall within the color reproduction range of the printing standard color. This means that a corporation or a group has an intention to transfer the message to users through the color, tone which is well refined. Accordingly, when corporate colors, logo marks or trade marks are printed, a specific one so-called a special toner has been often employed.

The special toner provides a brilliant and satisfactory toner image with uniform gloss, however, it requires change of a transporting path and a developing device of the special toner for each of different clients, which greatly increases maintenance time and lowers productivity.

Thus, there is still a difference between the standard color for printing and the discriminative color gamut range. Technique to minimize the difference and obtain a comfortable color image without apparent difference has been developed in the display field such as a television. Typical examples thereof include those disclosed in Japanese Patent O.P.I. Publication Nos. 2000-199982, 2001-312102 and 2006-78926. However, techniques disclosed in these patent documents have problem in that it is difficult to sufficiently present color reproduction to the level as required in the commercial printing field.

SUMMARY OF THE INVENTION

The present invention has been made in view of the above. An object of the invention is to provide a process of forming a full color image with uniform gloss, which realizes a color image with an extremely wide color gamut, and faithfully reproduces a color image as required by customers regarding a toner image of red, green or blue with a delicate color tone, which is often used in a corporate color or a logo mark as a secondary color according to a subtractive color system employing a yellow, magenta or cyan toner.

The present invention is a process of forming a full color image according to electrophotography, employing at least a yellow toner, a magenta toner and a cyan toner, the process comprising the step of forming a yellow toner image, a magenta toner image and a cyan toner image on a recording material, wherein the yellow toner image has reflectance (in terms of %) satisfying formulas (11) through (14) below, the magenta toner image has reflectance (in terms of %) satisfying formulas (21) through (24) below, and the cyan toner image has reflectance (in terms of %) satisfying formulas (31) through (34) below, $$2 \leqq A_{415}+A_{460} \leqq 24 \quad \text{Formula (11)}$$

$$20 \leqq A_{510}-A_{490} \leqq 40 \quad \text{Formula (12)}$$

$$2 \leqq A_{550}-A_{530} \leqq 16 \quad \text{Formula (13)}$$

$$70 \leqq A_{550} \quad \text{Formula (14)}$$

$$30 \leqq B_{450}-B_{520} \leqq 85 \quad \text{Formula (21)}$$

$$1 \leqq B_{530}+B_{570} \leqq 25 \quad \text{Formula (22)}$$

$$2 \leqq B_{670}-B_{600} \leqq 50 \quad \text{Formula (23)}$$

$$80 \leqq B_{670} \quad \text{Formula (24)}$$

$$4 \leqq |C_{480}-C_{450}| \leqq 16 \quad \text{Formula (31)}$$

$$15 \leqq C_{550}-C_{570} \leqq 35 \quad \text{Formula (32)}$$

$$20 \leqq C_{570} \leqq 50 \quad \text{Formula (33)}$$

$$0 \leqq C_{620}+C_{650} \leqq 30 \quad \text{Formula (34)}$$

BRIEF EXPLANATION OF THE DRAWING

FIG. 1 is a schematic view of one example of a tandem full color image formation apparatus capable of forming a full color image employing a two-component developer.

DETAILED DESCRIPTION OF THE INVENTION

The above object of the invention can be attained by any one of the following constitutions.

1. A process of forming a full color image according to electrophotography, employing at least a yellow toner containing a resin and a yellow colorant, a magenta toner containing a resin and a magenta colorant, and a cyan toner containing a resin and a cyan colorant, the process comprising the step of forming a yellow toner image, a magenta toner image and a cyan toner image on a recording material, wherein the yellow toner image has reflectance (in terms of %) satisfying formulas (11) through (14) below, the magenta toner image has reflectance (in terms of %) satisfying formulas (21) through (24) below, and the cyan toner image has reflectance (in terms of %) satisfying formulas (31) through (34) below, $$2 \leqq A_{415}+A_{460} \leqq 24 \quad \text{Formula (11)}$$

wherein $A_{415}$ and $A_{460}$ represent reflectance (in terms of %) at a wavelength of 415 nm and reflectance (in terms of %) at a wavelength of 460 nm, respectively, $$20 \leqq A_{510}-A_{490} \leqq 40 \quad \text{Formula (12)}$$

wherein $A_{510}$ and $A_{490}$ represent reflectance (in terms of %) at a wavelength of 510 nm and reflectance (in terms of %) at a wavelength of 490 nm, respectively, $$2 \leqq A_{550}-A_{530} \leqq 16 \quad \text{Formula (13)}$$

$$70 \leqq A_{550} \quad \text{Formula (14)}$$

wherein $A_{550}$ and $A_{530}$ represent reflectance (in terms of %) at a wavelength of 550 nm and reflectance (in terms of %) at a wavelength of 530 nm, respectively;

$$30 \leqq B_{450}-B_{520} \leqq 85 \quad \text{Formula (21)}$$

wherein $B_{450}$ and $B_{520}$ represent reflectance (in terms of %) at a wavelength of 450 nm and reflectance (in terms of %) at a wavelength of 520 nm, respectively, $$1 \leqq B_{530}+B_{570} \leqq 25 \quad \text{Formula (22)}$$

wherein $B_{530}$ and $B_{570}$ represent reflectance (in terms of %) at a wavelength of 530 nm and reflectance (in terms of %) at a wavelength of 570 nm, respectively, $$2 \leqq B_{670}-B_{600} \leqq 50 \quad \text{Formula (23)}$$

$$80 \leqq B_{670} \quad \text{Formula (24)}$$

wherein $B_{670}$ and $B_{600}$ represent reflectance (in terms of %) at a wavelength of 670 nm and reflectance (in terms of %) at a wavelength of 600 mm, respectively; and $$4 \leqq |C_{480}-C_{450}| \leqq 16 \quad \text{Formula (31)}$$

wherein $C_{480}$ and $C_{450}$ represent reflectance (in terms of %) at a wavelength of 480 nm and reflectance (in terms of %) at a wavelength of 450 nm, respectively, $$15 \leqq C_{550}-C_{570} \leqq 35 \quad \text{Formula (32)}$$

$$20 \leqq C_{570} \leqq 50 \quad \text{Formula (33)}$$

wherein $C_{550}$ and $C_{570}$ represent reflectance (in terms of %) at a wavelength of 550 nm and reflectance (in terms of %) at a wavelength of 570 nm, respectively, $$0 \leqq C_{620}+C_{650} \leqq 30 \quad \text{Formula (34)}$$

wherein $C_{620}$ and $C_{650}$ represent reflectance (in terms of %) at a wavelength of 620 nm and reflectance (in terms of %) at a wavelength of 650 nm, respectively.

2. The process of item 1 above, wherein the yellow toner image further has a reflectance at a wavelength of 415 nm reflectance $A_{415}$ of from 7 to 12% and a reflectance at a wavelength of 570 nm reflectance $A_{570}$ of from 75 to 85%.

3. The process of item 1 or 2 above, wherein the yellow colorant comprises a mixture of a first yellow colorant and a second yellow colorant, wherein the first yellow colorant is selected from the group X consisting of C.I. Pigment Yellow 3, C.I. Pigment Yellow 35, C.I. Pigment Yellow 65, C.I. Pigment Yellow 74, C.I. Pigment Yellow 98 and C.I. Pigment Yellow 111, the second yellow colorant is selected from the group Y consisting of C.I. Pigment Yellow 9, C.I. Pigment Yellow 36, C.I. Pigment Yellow 83, C.I. Pigment Yellow 110, C.I. Pigment Yellow 139, C.I. Pigment Yellow 181 and C.I. Pigment Yellow 153, and the content ratio by weight of the first colorant to the second pigment in the yellow toner is from 65:35 to 95:5.

4. The process of item 3 above, wherein the total content of the first yellow colorant and the second yellow colorant in the yellow toner is from 2 to 12 parts by weight, based on 100 parts by weight of the yellow toner.

5. The process of any one of items 1 through 4 above, wherein the softening point of the yellow toner, the magenta toner and the cyan toner is from 75 to 112° C.

6. The process of any one of items 1 through 5 above, wherein the yellow toner, the magenta toner and the cyan toner are particles of a core-shell structure which is composed of a shell comprised of a shell resin and covered therewith, a core comprised of a core resin and a colorant.

7. The process of item 6 above, wherein the glass transition temperature (Tg) of the core resin is in the range of from 10 to 50° C., and the glass transition temperature (Tg) of the shell resin is in the range of from 33 to 64° C.

8. The process of item 7 above, wherein the glass transition temperature (Tg) of the core resin is preferably lower than that of the shell resin.

9. The process of item 6 above, wherein the core resin is a copolymer having therein a monomer unit selected from the group consisting of propyl acrylate, propyl methacrylate, butyl acrylate, butyl methacrylate, 2-ethylhexyl acrylate and 2-ethylhexyl methacrylate, and the shell resin is a copolymer having therein a monomer unit selected from the group consisting of styrene, methyl methacrylate and methacrylic acid.

10. The process of any one of items 1 through 9 above, wherein the yellow toner, the magenta toner and the cyan toner are particles having a volume-based median diameter of from 3 to 8 μm.

11. The process of any one of items 1 through 10 above, wherein the magenta colorant comprises a mixture of a pigment or a dye with a complex, wherein the pigment is selected from the group consisting of C.I. Pigment Red 2, 3, 6, 7, 9, 15, 16, 48:1, 48:3, 53:1, 57:1, 122, 123, 139, 144, 149, 166, 177, 178, 208, 209 and 222; the dye is selected from the group consisting of C.I. Solvent Red 3, 14, 17, 18, 22, 23, 49, 51, 53, 87, 127, 128, 131, 145, 146, 149, 150, 151, 152, 153, 154, 155, 156, 157, 158, 176 and 179; and the complex is selected from the group consisting of complexes 1, 2, 3 and 4 shown below, Complex 1

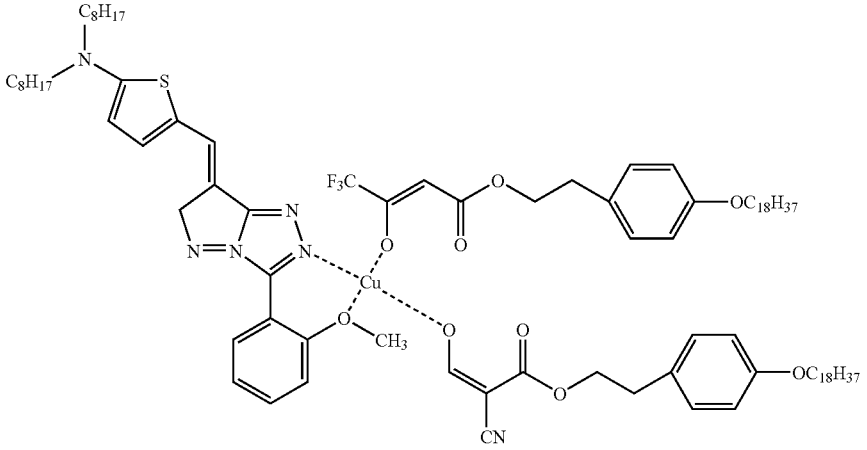

-continued

Complex 2

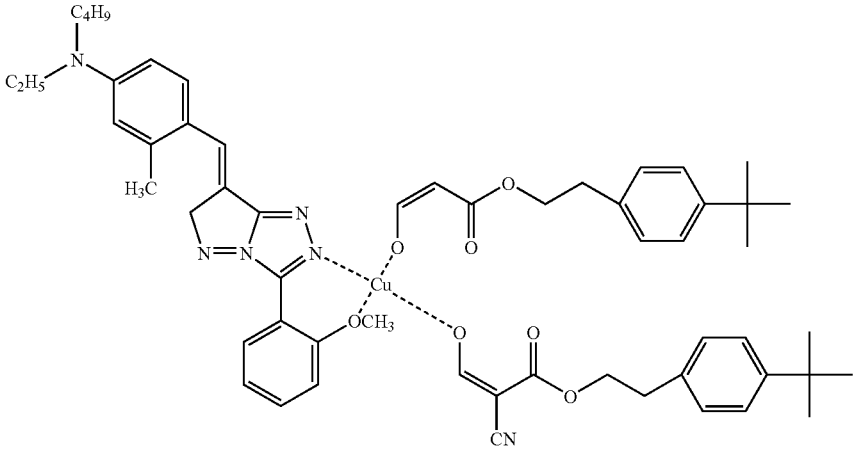

Complex 3

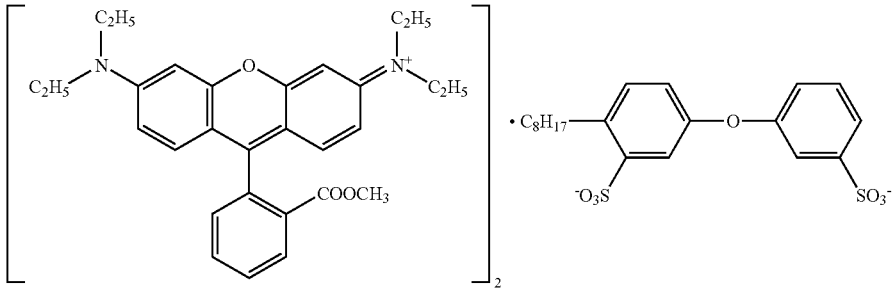

Complex 4

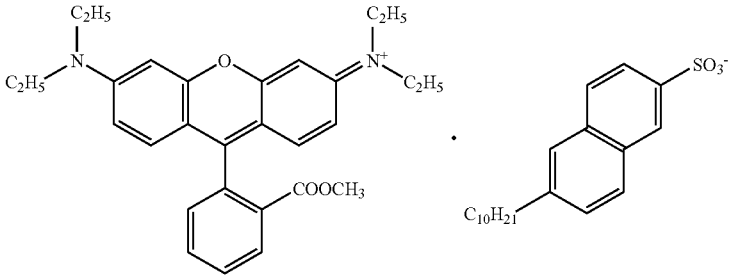

12. The process of any one of items 1 through 10 above, wherein the cyan colorant comprises a silicon phthalocyanine compound represented by the following formula (I), Formula (I)

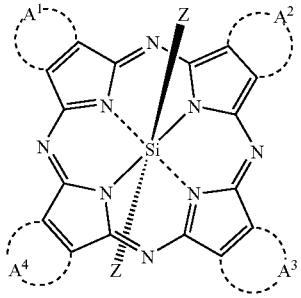

wherein Z represents a hydroxyl group, a chlorine atom, an aryloxy group with a carbon atom number of from 6 to 18, an alkoxy group with a carbon atom number of from 1 to 22, or a group represented by formula (IV) below, Formula (IV)

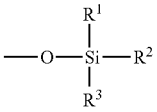

in which $R^1$, $R^2$ and $R^3$ independently represent an alkyl group with a carbon atom number of from 1 to 22, an aryl group with a carbon atom number of from 6 to 18, an alkoxy group with a carbon atom number of from 1 to 22, an aryloxy group with a carbon atom number of from 6 to 18, provided that $R^1$, $R^2$ and $R^3$ may be the same or different; $A^1$, $A^2$, $A^3$ and $A^4$ independently represent an atomic group necessary to form a benzene ring, provided that the benzene ring may have a substituent.

13. The process of item 12 above, wherein the cyan colorant further comprises a compound represented by the following formula (II), Formula (II)

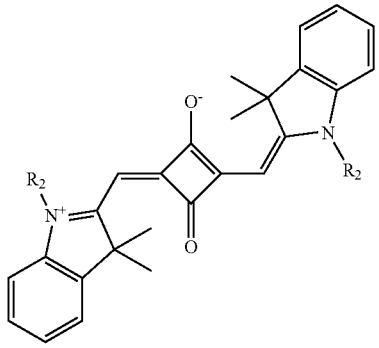

wherein $R_2$ represents a hydrogen atom or an organic group.

14. The process of any one of items 1 through 13 above, wherein the resin content of the yellow toner, the resin content of the magenta toner and the resin content of the cyan toner are from 60 to 95% by weight.

The present invention can provide a full color image formation process providing a secondary color image with high chroma, excellent color reproduction and extremely wide color gamut. As a result, a color image with chroma, color reproduction and wide color gamut to the level required in the commercial printing filed can be obtained. The color tone of a corporate color or a logo mark for announcing the company mission to the market can be faithfully reproduced through the delicate color tone, and intention of an advertising agency can be faithfully conveyed to the market through color.

Next, the present invention will be explained in detail.

The full color image formation process of the invention comprises the step of forming a full color image, employing a yellow toner containing at least a resin and a colorant, wherein a yellow toner image formed employing only the yellow toner has reflectance (in terms of %) satisfying formulas (11) through (14) below.

$$2 \leqq A_{415}+A_{460} \leqq 24 \quad \text{Formula (11)}$$

wherein $A_{415}$ and $A_{460}$ represent reflectance (in terms of %) at a wavelength of 415 nm and reflectance (in terms of %) at a wavelength of 460 nm, respectively, $$20 \leqq A_{510}-A_{490} \leqq 40 \quad \text{Formula (12)}$$

wherein $A_{510}$ and $A_{490}$ represent reflectance (in terms of %) at a wavelength of 510 nm and reflectance (in terms of %) at a wavelength of 490 nm, respectively, $$2 \leqq A_{550}-A_{530} \leqq 16 \quad \text{Formula (13)}$$

$$70 \leqq A_{550} \quad \text{Formula (14)}$$

wherein $A_{550}$ and $A_{530}$ represent reflectance (in terms of %) at a wavelength of 550 nm and reflectance (in terms of %) at a wavelength of 530 nm, respectively.

When a full color image is formed employing a yellow toner forming a yellow toner image satisfying the constitutions as described above, a secondary toner image formed has high chroma and excellent color reproduction. Further, coloration with an extremely wide color gamut can be realized. When formulas (11), (12) and (13) above are satisfied, and formulas (31) through (34) described later, which relates to reflectance of a cyan toner image, are satisfied, a green color gamut greatly increases as compared with that obtained according to a conventional electrophotographic method, and a brilliant yellow color image can be obtained. Further, when formulas (12), (13) and (14) above are satisfied, and formulas (22) through (24) described later, which relates to reflectance of a magenta toner image, are satisfied, a sufficient color gamut and lightness can be obtained in the orange to red regions.

In the full color image formation process of the invention, a magenta toner image formed employing only a magenta toner has reflectance (in terms of %) satisfying formulas (21) through (24) below $$30 \leqq B_{450}-B_{520} \leqq 85 \quad \text{Formula (21)}$$

wherein $B_{450}$ and $B_{520}$ represent reflectance (in terms of %) at a wavelength of 450 nm and reflectance (in terms of %) at a wavelength of 520 nm, respectively, $$1 \leqq B_{530}+B_{570} \leqq 25 \quad \text{Formula (22)}$$

wherein $B_{530}$ and $B_{570}$ represent reflectance (in terms of %) at a wavelength of 530 nm and reflectance (in terms of %) at a wavelength of 570 nm, respectively, $$2 \leqq B_{670}-B_{600} \leqq 50 \quad \text{Formula (23)}$$

$$80 \leqq B_{670} \quad \text{Formula (24)}$$

wherein $B_{670}$ and $B_{600}$ represent reflectance (in terms of %) at a wavelength of 670 nm and reflectance (in terms of %) at a wavelength of 600 nm, respectively.

When a full color image is formed employing a magenta toner forming a magenta toner image satisfying the constitutions as described above, a secondary toner image formed has high chroma and excellent color reproduction. Further, coloration with an extremely wide color gamut can be realized. For example, when formulas (21) and (22) above are satisfied, and formulas (31) through (34) described later, which relates to reflectance of a cyan toner image, are satisfied, a color gamut in the blue to violet regions greatly increases as compared with that obtained according to a conventional electrophotographic method, and a bright coloration of magenta shocking pink color can be obtained.

In the full color image formation process of the invention, formulas (11) through (14) and formulas (21) through (24) above are satisfied, a cyan toner image formed employing only a cyan toner has reflectance (in terms of %) satisfying formulas (31) through (34) below.

$$4 \leqq |C_{480}-C_{450}| \leqq 16 \quad \text{Formula (31)}$$

wherein $C_{480}$ and $C_{450}$ represent reflectance (in terms of %), at a wavelength of 0.480 nm and reflectance (in terms of %) at a wavelength of 450 nm, respectively, $$15 \leqq C_{550}-C_{570} \leqq 35 \quad \text{Formula (32)}$$

$$20 \leqq C_{570} \leqq 50 \quad \text{Formula (33)}$$

wherein $C_{550}$ and $C_{570}$ represent reflectance (in terms of %) at a wavelength of 550 nm and reflectance (in terms of %) at a wavelength of 570 nm, respectively, and $$0 \leqq C_{620}+C_{650} \leqq 30 \quad \text{Formula (34)}$$

wherein $C_{620}$ and $C_{650}$ represent reflectance (in terms of %) at a wavelength of 620 nm and reflectance (in terms of %) at a wavelength of 650 nm, respectively.

When a full color image is formed employing a cyan toner having the constitution as described above, a secondary toner image formed has high chroma and excellent color reproduction. Further, coloration with an extremely wide color gamut can be realized.

The reflectance at each of the wavelengths as described above of a toner image formed employing the yellow, magenta or cyan toner is determined employing a spectrophotometer "GRETAG MACBETH SPECTROLINO" (produced by Gretag Macbeth Co.) The reflectance determination conditions are as follows:

Light source used: Light source D65
Reflection determination aperture: 4 mmϕ
Determination wavelength range: 380 to 730 nm
wavelength interval: 10 nm,
Viewing angle (observer): 2°,
Reference used: Exclusive white tile That is, the reflectance is determined from the reflectance spectrum-obtained through the spectrophotometer above.

The reflectance of a yellow, magenta or cyan toner image is measured as follows.

Firstly, a yellow, magenta or cyan toner image is formed on a transfer paper to have a toner coating amount of 8.0 μg/m2. Herein, the transfer paper used is one having a basis weight of 128 g/m$^2$ and a lightness of about 93. There is, for example, a transfer paper "POD GLOSS COAT" (produced by Oji Paper Co., Ltd.). Then, each toner image formed is fixed under the standard fixing condition of the image forming apparatus used in the invention. For example, a toner image having a glossiness of at least 10 is measured, the glossiness being measured at a measurement angle of 75° employing a Gloss Meter produced by Murakami Shikisai Kogaku Kenkyusho.

Next, the yellow toner used in the invention will be explained.

The yellow toner used in the invention is composed of yellow toner particles which contain at least a resin and a yellow colorant. In the reflectance spectrum of a yellow toner image formed employing only the yellow toner, the difference $\Delta A$ ($=A_{510}-A_{490}$) between reflectance $A_{510}$ at a wavelength of 510 nm and reflectance $A_{490}$ at a wavelength of 490 nm is in the range of from 20 to 40% and preferably 25 to 35%. Further, it is preferred that in the reflectance spectrum, the yellow toner image described above has reflectance $A_{415}$ at a wavelength of 415 nm in the range of 7 to 12%, and reflectance $A_{570}$ at a wavelength of 570 nm in the range of 75 to 85%. In contrast, $\Delta A$ ($=A_{510}-A_{490}$) of the yellow toner image formed employing a yellow toner used in a conventional electrophotographic method is generally in the range of 45 to 50%, which can not provide excellent coloration in the green region and in the orange to red regions as obtained in the invention.

<Chroma and Maximum Chroma>

Next, maximum chroma C* of a toner image will be explained.

(1) Maximum Chroma of Yellow Toner Image

A yellow toner image has a maximum chroma $C^*_Y$ of preferably from 85 to 115 from the viewpoint of forming a secondary color of green and red.

Herein, the maximum chroma $C^*_Y$ is defined as follows. When the colorant content of toner particles is high, chroma increases in almost proportion to the toner coating amount, but when the colorant content of toner particles exceeds a certain amount, chroma, even when the toner coating amount is increased, does not increase but becomes constant, followed by decreasing. Chroma, such that it changes from increase to decrease even when the toner coating amount is increased, is defined as maximum chroma. When the toner coating amount is in proportion to chroma, chroma of a toner image with a maximum toner coating amount on a transfer paper capable of being set employing an image formation apparatus used is also defined as maximum chroma.

Image output can be carried out employing ECI-2002 chart (Random Layout) recommended by ECI (European Color Initiative). As a transfer paper used to measure chroma or lightness, there is one having a basis weight of 128 g/m$^2$ and a lightness of about 93. There is, for example, a transfer paper "POD GLOSS COAT" (produced by Oji Paper Co.; Ltd.). Chroma or lightness is measured employing a toner image fixed under the standard fixing condition of the image forming apparatus used in the invention. Chroma or lightness is measured employing for example, a toner image having a glossiness of at least 10, the glossiness being measured at a measurement angle of 75° employing a Gloss Meter produced by Murakami Shikisai Kogaku Kenkyusho.

The maximum chroma of a yellow toner image is one obtained from measurement at a hue angle h in the range of from 60 to 90°.

When a yellow toner image has a maximum chroma, lightness $L_Y^*$ of the yellow toner image is adjusted to be preferably from 80 to 90, and more preferably from 85 to 90 from the viewpoint of forming a secondary color of green and red.

(2) Maximum Chroma of Magenta Toner Image

A magenta toner image has a maximum chroma $C^*_M$ of preferably from 70 to 100 from the viewpoint of forming a secondary color of blue and red. The maximum chroma is defined in the same manner as in the yellow toner image above.

The maximum chroma of a magenta toner image is one obtained from measurement at a hue angle h in the range of from 300 to 330°. When a magenta toner image has a maximum chroma, lightness $L_M^*$ of the magenta toner image is adjusted to be preferably from 31 to 51, and more preferably from 40 to 49 from the viewpoint of forming a secondary color of blue, violet and red.

(3) Maximum Chroma of Cyan Toner Image

A magenta toner image has a maximum chroma $C^*_C$ of preferably from 50 to 800 from the viewpoint of forming a secondary color of green and blue. The maximum chroma is defined in the same manner as in the yellow toner image above.

The maximum chroma of a cyan toner image is one obtained from measurement at a hue angle h in the range of from 300 to 330°.

When a cyan toner image has a maximum chroma, lightness $L_C^*$ of the cyan toner image is adjusted to be preferably from 53 to 70, and more preferably from 57 to 67 from the viewpoint of forming a secondary color of yellow-green, green and blue.

When a magenta or cyan toner image is represented employing the above L*a*b* color representation system, chroma C* is preferably not less than 65, and more preferably not less than 70.

Chroma C* falling within the above range can provide a visible color image with an extremely wide color gamut, which is formed via superposition of other color toner images in which lightness is in the medium to high range. Thus, chroma C* not less than 65 can provide a visible color image with no color contamination and with high sharpness which is formed via superposition of other color toner images.

Herein, Chroma C* refers to a distance from origin C to point (a, b) in the above coordinate, and is calculated based on the following formula (2).

$$\text{Chroma } C^* = [(a^*)^2 + (b^*)^2]^{1/2} \qquad \text{Formula (2)}$$

"L*a*b* color system", as described herein, is one method which is employed to represent color as numeric values L* is the coordinate in the z axis direction and represents lightness, and a* and b* are coordinates of the x-coordinate and the y coordinate, respectively, and their combination represents hue and chroma. Herein, lightness refers to relative brightness of color; hue refers to color shade such as red, yellow, green, blue or violet; and chroma refers to a degree of brilliance of color.

Further, hue angle h refers to the following. For example, when lightness results in a certain value, on an x axis-y axis plane representing the relationship between hue and chroma, the hue angle is the angle of the half-line passing through a certain coordinate point (a, b) and origin O to the straight line extending to the + direction (red direction) of the x axis in the counterclockwise direction from the + direction (red direction) of the x axis, and is calculated according to the following formula (1).

$$\text{Hue angle } h=\tan^{-1}(b^*/a^*) \qquad \text{Formula (1)}$$

Meanwhile, in the x axis-y axis plane, the – direction of the x axis, represented by a*, is the green direction, the + (plus) direction of the y axis, represented by b*, is the yellow direction, and the – (minus) direction of the y axis is the blue direction.

L*a*b*, which is employed to calculate hue angle h, can be determined through a spectrophotometer "GRETAG MACBETH SPECTROLINO" (produced by Gretag Macbeth Co.). The determination method and an image to be determined is the same as in the determination of the reflection spectra. That is, a light source D65 is employed as a light source, one at a reflection determination aperture of 4 mmϕ is employed, the interval in the determination wavelength range of from 380 to 730 nm is 10 nm, the viewing angle (observer) is set at 20, and an exclusive white tile is employed as a reference.

A color toner image to be measured is formed on a transfer paper to have a toner coating amount of 8.0 g/m$^2$. Herein, the transfer paper used is one having a basis weight of 128 g/m$^2$ and a lightness of about 93. There is, for example, a transfer paper "POD GLOSS COAT" (produced by Oji Paper Co., Ltd.). Then, a toner image formed is fixed under the standard fixing condition of the image forming apparatus used in the invention. For example, a toner image having a glossiness of at least 10 is measured, the glossiness being measured at a measurement angle of 75° employing a Gloss Meter produced by Murakami Shikisai Kogaku Kenkyusho.

L*a*b*, which is employed to calculate chroma C*, can be determined through a spectrophotometer "GRETAC MACBETH SPECTROLINO" (produced by Oretag Macbeth Co.). The determination method and an image to be determined is the same as in the determination of the reflection spectra. That is, a light source D65 is employed as a light source, one at a reflection determination aperture of 4 mmϕ is employed, the interval in the determination wavelength range of from 380 to 730 nm is 10 nm, the viewing angle (observer) is set at 2°, and an exclusive white tile is employed as a reference.

Next, the color toner used in the invention will be explained. Firstly, a colorant contained in the toner used in the invention will be explained.

[Yellow Colorant]

The yellow colorant used in the invention is preferably a mixture of a first yellow colorant selected from the group X consisting of the colorants described later and a second yellow colorant selected from the group Y consisting of the colorants described later. The mixing ratio by weight of the first yellow colorant to the second yellow colorant is preferably from 65:35 to 95:5.

The total content of the first yellow colorant and the second yellow colorant in the yellow toner particles is in the range of from 2 to 12 parts by weight, and preferably from 4 to 10 parts by weight with respect to 100 parts by weight of the yellow toner particles.

[Group X]: C.I. Pigment Yellow 3, C.I. Pigment Yellow 35, C.I. Pigment Yellow 65, C.I. Pigment Yellow 74, C.I. Pigment Yellow 98, and C.I. Pigment Yellow 111,

[Group Y] C.I. Pigment Yellow 9, C.I. Pigment Yellow 36, C.I. Pigment Yellow 83, C.I. Pigment Yellow 110, C.I. Pigment Yellow 139, C.I. Pigment Yellow 181, and C.I. Pigment Yellow 153

Group X can be selected among colorants called very greenish to greenish yellow according to the grades of colorants available on the market. Group Y can be selected among colorants called (normal) yellow to reddish yellow.

The mixture as described above of the yellow colorants as listed above is one embodiment for providing a specific reflectance as described, but the invention is not limited thereto.

It is possible to employ, as a colorant, a surface-modified. Those conventionally known can be employed as a surface modifying agent, but a silane coupling agent, a titanium coupling agent, an aluminum coupling agents and rosin are preferably employed.

A specific surface modifying method follows. A colorant is dispersed in a solvent and added with a surface modifying agent. The resulting mixture is then heated to undergo reaction. After the reaction, the colorant is collected via filtration, and washing and filtration are repeated employing the same solvents, followed by drying, whereby a colorant treated with the surface modifying agent are obtained.

[Magenta Colorant]

In the invention, a yellow toner image formed employing a yellow toner has reflectance (in terms of %) satisfying formulas (11) through (14) above, and a magenta toner image employing only a magenta toner has reflectance (in terms of %) satisfying formulas (21) through (24) below.

$$30 \leqq B_{450}-B_{520} \leqq 85 \qquad \text{Formula (21)}$$

wherein $B_{450}$ and $B_{520}$ represent reflectance (in terms of %) at a wavelength of 450 nm and reflectance (in terms of %) at a wavelength of 520 nm, respectively, $$1 \leqq B_{530}+B_{570} \leqq 25 \qquad \text{Formula (22)}$$

wherein $B_{530}$ and 8570 represent reflectance (in terms of %) at a wavelength of 530 nm and reflectance (in terms of %) at a wavelength of 570 nm, respectively, $$2 \leqq B_{670}-B_{600} \leqq 50 \qquad \text{Formula (23)}$$

$$80 \leqq B_{670} \qquad \text{Formula (24)}$$

wherein $B_{670}$ and $B_{600}$ represent reflectance (in terms of %) at a wavelength of 670 nm and reflectance (in terms of %) at a wavelength of 600 nm, respectively.

As a colorant used in the magenta toner capable of forming a toner image satisfying the above formulas (21) through (24), a mixture of the following pigment or the following dye or with the following complex is preferred.

Examples of a pigment for magenta toner include C.I. Pigment Red 2, 3, 6, 7, 9, 15, 16, 48:1, 48:3, 53:1, 57:1, 122, 123, 139, 144, 149, 166, 177, 178, 208, 209, and 222.

Examples of a dye for magenta include C.I. Solvent Red 3, 14, 17, 18, 22, 23, 49, 51, 53, 87, 127, 128, 131, 145, 146, 149, 150, 151, 152, 153, 154, 155, 156, 157, 158, 176 and 179. Examples of a dye for magenta include C.I. Solvent Red 3, 14, 17, 18, 22, 23, 49, 51, 53, 87, 127, 128, 131, 145, 146, 149, 150, 151, 152, 153, 154, 155, 156, 157, 158, and 179. Further, the dye can be selected from Sekishoku No. 2, Sekishoku No. 3, Sekishoku No. 102, Sekishoku No. 104-(1), Sekishoku No. 105-(1), Sekishoku No. 106, Sekishoku No. 201, Sekishoku No. 202, Sekishoku No. 203, Sekishoku No. 204, Sekishoku No. 205, Sekishoku No. 206, Sekishoku No. 215, and Sekishoku No. 236, which are dye names in Shorei 41/S47, H15, H16 listing a tar dye usable for medicines defined by Japan Kosei Rodo sho.

Examples of a complex for magenta colorants include complexes 1 through 4 as shown below.

Complex 1

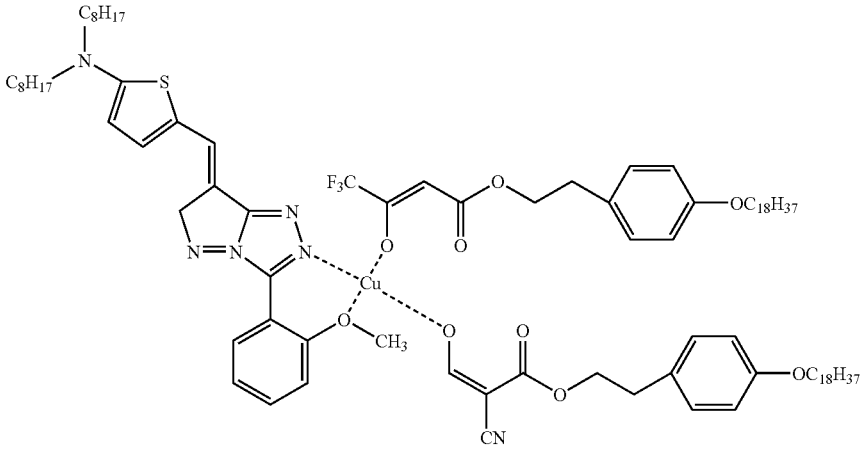

Complex 2

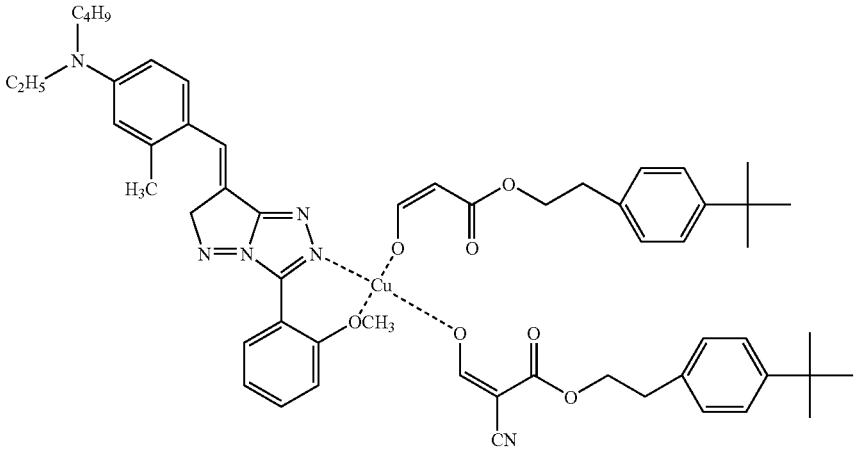

Complex 3

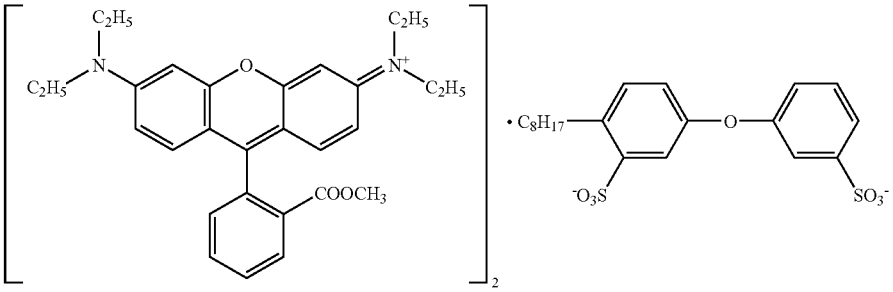

Complex 4

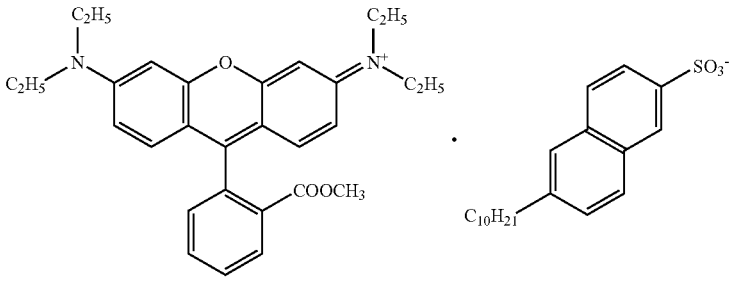

It is preferred that among these, C.I. Pigment red 9, C.I. Pigment red 208, C.I. Pigment red 209 or Complex 1, 2, 3 or 4 is used. In the invention, it is preferred that the colorants as described above are used in combination to obtain a magenta colorant.

[Cyan Colorant]

In the invention, a yellow toner image formed employing a yellow toner has reflectance (in terms of %) satisfying formulas (11) through (14) above, a magenta toner image employing a magenta toner has reflectance (in terms of %) satisfying formulas (21) through (24) above, and a cyan toner image employing a cyan toner has reflectance (in terms of %) satisfying formulas (31) through (34) below.

$$4 \leqq |C_{480}-C_{450}| \leqq 16 \quad \text{Formula (31)}$$

wherein $C_{480}$ and $C_{450}$ represent reflectance (in terms of %) at a wavelength of 480 nm and reflectance (in terms of %) at a wavelength of 450 nm, respectively, $$15 \leqq C_{550}-C_{570} \leqq 35 \quad \text{Formula (32)}$$

$$20 \leqq C_{570} \leqq 50 \quad \text{Formula (33)}$$

wherein $C_{550}$ and $C_{570}$ represent reflectance (in terms of %) at a wavelength of 550 nm and reflectance (in terms of %) at a wavelength of 570 nm, respectively, and $$0 \leqq C_{620}+C_{650} \leqq 30 \quad \text{Formula (34)}$$

wherein $C_{620}$ and $C_{650}$ represent reflectance (in terms of %) at a wavelength of 620 nm and reflectance (in terms of %) at a wavelength of 650 nm, respectively.

As a colorant used in the cyan toner capable of forming a toner image satisfying the above formulas (31) through (34), there are mentioned silicon phthalocyanine compounds as shown later. However, colorants used in a cyan toner forming a toner image satisfying the formulas (31) through (34) above are not limited thereto.

Next, explanation will be made of a silicon phthalocyanine compound, which is one example of colorants preferably used in a cyan toner used in the invention. One of the cyan toners exhibiting the effects of the invention contains at least a resin and a colorant, wherein the colorant includes a silicon phthalocyanine compound represented by formula (1) described later. As a silicon phthalocyanine compound represented by formula (1) is used a silicon phthalocyanine compound in which a silicon atom (Si) is used as a metal atom (hereinafter also referred to as a center metal atom) positioned at the center of the phthalocyanine ring.

Formula (I)

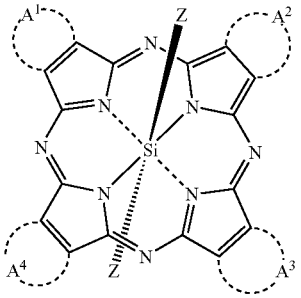

In formula (1), Z represents a hydroxyl group, a chlorine atom, an aryloxy group with a carbon atom number of from 6 to 18, an alkoxy group with a carbon atom number of from 1 to 22, and a group represented by formula (IV) below Formula (IV)

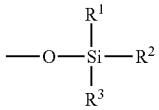

In formula (IV), $R^1$, $R^2$ and $R^3$ independently represent an alkyl group with a carbon atom number of from 1 to 22, an aryl group with a carbon atom number of from 6 to 18, an alkoxy group with a carbon atom number of from 1 to 22, an aryloxy group with a carbon atom number of from 6 to 18, provided that $R^1$, $R^2$ and $R^3$ may be the same or different. The carbon atom number of the alkyl, aryl, alkoxy or aryloxy group represented by $R^1$, $R^2$ or $R^3$ is preferably from 1 to 10, and more preferably from 2 to 8.

In formula (1, $A^1$, $A^2$, $A^3$, and $A^4$ represent an atomic group necessary to form a benzene ring, provided that the benzene ring may have a substituent such as a halogen atom or a halogenated alkyl group.

The phthalocyanine compound represented by formula (I) has a silicon atom as the center metal atom and a substituent represented by Z, and is also called a tatraazaporphyrin compound. A toner containing a compound represented by formula (I) can provide high color reproducibility as compared with a toner containing a phthalocyanine compound having no substituent Z. This is considered to be because the silicon phthalocyanine compound represented by formula (I) having a substituent Z is complex in chemical structure as compared with a silicon phthalocyanine compound having no substituent Z, and is difficult to aggregate or crystallize in the cyan toner particles. Accordingly, it is supposed that the former phthalocyanine compound is likely to uniformly disperse in the cyan toner particles or in the cyan toner image, resulting in high color reproducibility.

It is supposed that the phthalocyanine compound having a structure difficult to aggregate or crystallize increases its compatibility with a resin in the toner or its solubility in a solvent or a polymerizable monomer and is likely to disperse in the toner during manufacture, which provides good color reproducibility.

It is especially preferred that the substituent Z constituting the compound represented by formula (1) is a group represented by formula (IV). In formula (IV), $R^1$, $R^2$ and $R^3$ each are preferably an alkyl group with a carbon atom number of from 1 to 6, an aryl group or an alkoxy group, and more preferably an n-propyl group, an isopropyl group, an n-butyl group, an isobutyl group or a t-butyl group, provided that $R^1$, $R^2$ and $R^3$ may be the same or different.

The phthalocyanine compounds described above can be used singly or as an admixture of two or more kinds thereof in the cyan toner used in the invention. The content of the phthalocyanine compound above in the toner is preferably from 1 to 30% by weight, and more preferably from 2 to 20% by weight, based on the total weight of the toner. This compound is expected to exhibit the effect of the invention in a small amount, since it can expect to have high molecular absorption.

Examples of the tetraazaporphyrin compound (a phthalocyanine compound having a substituent Z) represented by formula (I) will be listed in Table 1, but the compound represented by formula (1) used in the toner in the invention is not limited thereto.

TABLE 1

| Compound No. | $A^1$, $A^2$, $A^3$ & $A^4$ | Z |
|---|---|---|
| I-1 | (i) | —O—$Si(CH_2CH_3)_3$ |
| I-2 | (i) | —OH |
| I-3 | (i) | —O—$Si(CH_2CH_2CH_3)_3$ |
| I-4 | (i) | —O—$Si(CH_3)_3$ |
| I-5 | (i) | —O—$Si(CH(CH_3)_2)_3$ |
| I-6 | (i) | —Cl |
| I-7 | (i) | —O—$Si(CH_2CH_2CH_2CH_2CH_2CH_2CH_2CH_3)(CH_3)_2$ |
| I-8 | (i) | —O—$Si(t\text{-}C_4H_9)_3$ |
| I-9 | (ii) | —O—$Si(CH_2CH_3)_3$ |
| I-10 | (iii) | —O—$Si(CH_2CH_3)_3$ |
| I-11 | (iv) | —O—$Si(CH_2CH_3)_3$ |
| I-12 | (i) | —O—$Si(C_{11}H_{23})(CH_3)_2$ |
| I-13 | (i) | —O—$Si(C_{22}H_{45})(CH_2CH_3)(CH_3)$ |
| I-14 | (i) | —O—$Si(CH_2CH_3)(CH_3)(C_6H_5)$ |
| I-15 | (i) | —O—$Si(CH_2CH_3)(CH_3)(C_{18}H_{11})$ |
| I-16 | (i) | —O—$Si(OCH_3)(OC_{22}H_{45})CH_3$ |
| I-17 | (i) | —O—$Si(OC_2H_5)_2(OC_{10}H_{21})$ |
| I-18 | (i) | —O—$CH_3$ |
| I-19 | (i) | —O—$CH_2CH_3$ |
| I-20 | (i) | —O—$CH_2(CH_2)_6CH_3$ |
| I-21 | (i) | —O—$C_{11}H_{23}$ |
| I-22 | (i) | —O—$C_{22}H_{25}$ |
| I-23 | (i) | —$OC_6H_5$ (Phenoxy) |
| I-24 | (i) | —$OC_{10}H_7$ (Naphthoxy) |
| I-25 | (i) | —$OC_{14}H_9$ (Anthryloxy) |
| I-26 | (i) | —$OC_{16}H_9$ (Pyrenyloxy) |
| I-27 | (i) | —$OC_{18}H_{11}$ |

(i)

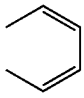

(ii)

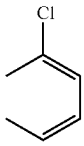

(iii)

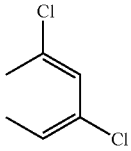

(iv)

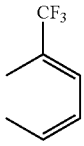

Among the silicon phthalocyanine compounds as shown in Table 1, compound (1-4) is especially preferred.

As a colorant used in combination with the silicon phthalocyanine compound, there is mentioned a compound represented by the following formula (II).

Formula (II)

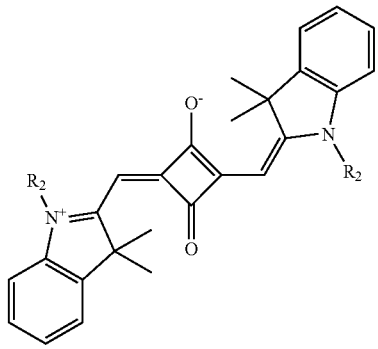

In formula (II), $R_2$ represents a hydrogen atom or an organic group such as an alkyl group. Examples of the compound represented by formula (II) will be listed below.

(II-1)

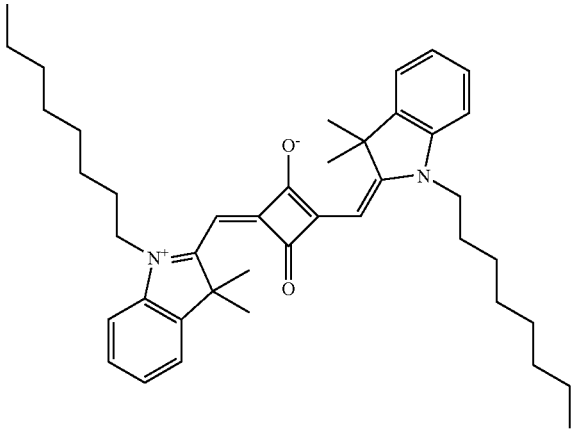

(II-2)

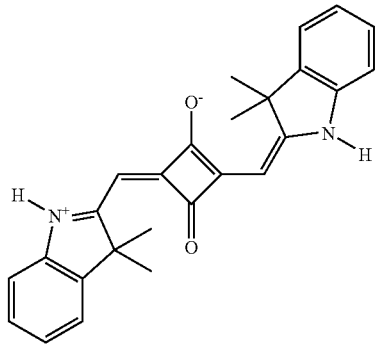

(II-3)

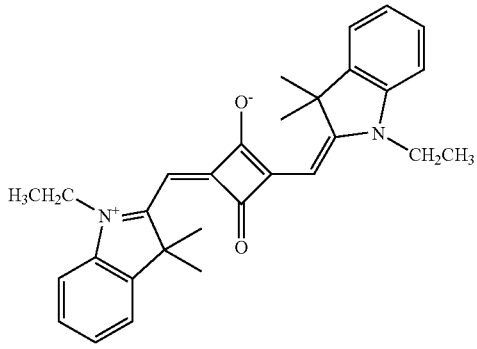

-continued (II-4)

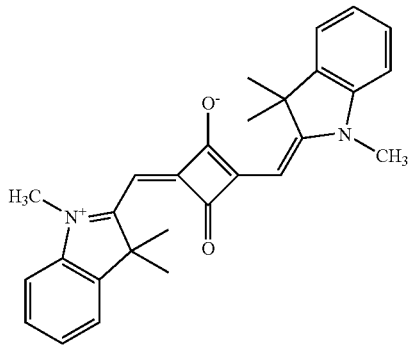

(II-5)

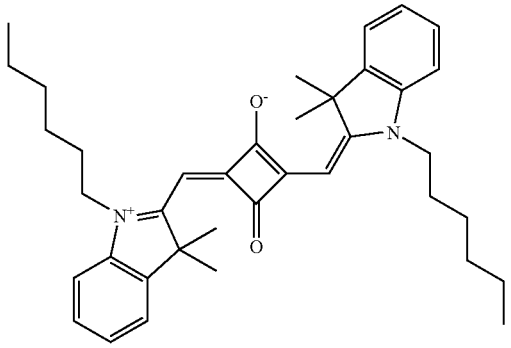

(II-6)

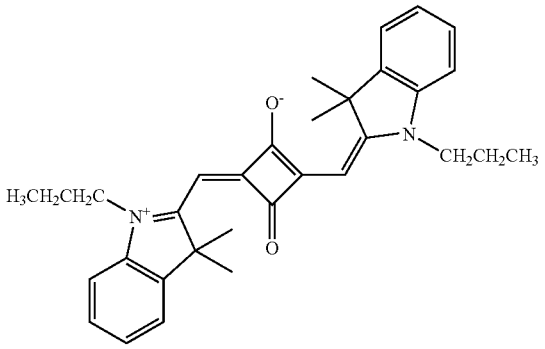

<Softening Point of Yellow, Magenta and Cyan Toners>

The softening point temperature of the yellow, magenta or cyan toner of the present invention is preferably from 75 to 112° C., and is more preferably from 80 to 100° C.

The softening point of the toner falling within the above range can provide an appropriate fusion state of the yellow, magenta or cyan toner during the fixing process, whereby excellent color reproduction of secondary colors is realized.

"Appropriate fusion state of the yellow, magenta or cyan toner" as described herein, refers to the state in which when a color image is formed by superimposing a toner image of a yellow, magenta or cyan toner with toner images of other color toners, a yellow, magenta or cyan colorant in the toner image formed via the above yellow, magenta or cyan toner and magenta dyes incorporated in the toner image of, for example, a magenta toner are subjected to color superposition on a recording material and fixed, yellow pigments and magenta dyes form the color while uniformly dispersed and yellow pigments do not ooze out of the region of the exterior of the above color image region in a state of elimination of the interface of the layers formed employing both binder resins.

The yellow toner used in the present invention is employed together with a magenta toner, a cyan toner, and a black toner to form a color image. It is preferred that the above magenta toner, cyan toner and black toner are designed so that their softening point and particle diameter are identical to those of the yellow toner.

Softening point of a color toner herein refers to that which is determined as follows. A color toner of 1.1 g is placed in a Petri dish at a temperature of 20° C. and at a relative humidity of 50%, flattened out, and allowed to stand for at least 12 hours. Thereafter, a 1 cm diameter cylindrical molded sample is prepared via application of a pressure of 3,820 kg/cm$^2$ employing a molding machine "SSP-10A" (produced by Shimadzu Corp.). Subsequently, the resulting sample was measured under a temperature of 24° C. and a relative humidity of 50%, employing a flow tester "CFT-500D" (produced by Shimadzu Corp.). The resulting sample is extruded from a cylindrical die hole (1 mm diameter×1 mm) employing a 1 cm diameter piston after 300 second pre-heating under conditions of an applied load of 196 N (20 kgf), an initial temperature of 60° C., and a temperature raising rate of 6° C./minute, and offset method temperature $T_{offset}$ which is determined based on the fusion temperature determination method according to the temperature raising method, which is set at an offset value of 5 mm, is designated as the softening point of the color toner.

The softening point of a resin constituting the color toner particles, when the resin is a vinyl copolymer, can be controlled by adjusting the copolymerization ratio of polymerizable monomers or the molecular weight according to regulation of the degree of polymerization. For example, in a copolymer prepared employing styrene and butyl methacrylate, it is possible to prepare a copolymer with a higher softening point by increasing the content ratio of styrene in the copolymer. Further when the resin is a polyester resin, it is possible to control the softening point via appropriate selection of the type of polymerizable monomers or adjustment of the copolymerization ratio of copolymerization monomers.

<Particle Diameter of Color Toner Particles>

The particle diameter (in terms of volume based median diameter) of the color toner particles constituting the color toner in the invention is preferably from 3.0 to 10.0 μm, and is more preferably from 3.5 to 8.0 μm. When the toner particles are formed via a polymerization method, it is possible to control the above particle diameter via the concentration and added amount of a coagulant, the aggregation period, and the composition of the polymer itself during the manufacturing process of the color toner.

The particle diameter of the color toner particles falling within the above range is preferred in that since reproduction of each of the different color dots is enhanced, color gamut of a secondary color, i.e., red, orange, blue, bluish violet or green, is enlarged, even when the different color dots are overlapped or adjacent to each other.

The volume based median diameter of the color toner is determined and calculated employing a measuring device in which a data processing computer system (produced by Beckmann-Coulter Co.) is connected to "COULTER MULTISIZER TA-III". For example, 0.02 g of a color toner is added to 20 ml of a surface active agent solution (a surface active agent solution which is prepared by diluting a neutral detergent containing surface active agent components with purified water by a factor of 10 for the purpose of dispersing the color toner). After sufficient blending, ultrasonic dispersion is carried out over one minute to obtain a color toner dispersion. The resulting color toner dispersion is injected, employing a pipette, into a beaker on the sample stand, in which electrolyte "ISOTON II" (produced by Beckmann-Coulter Co.) is incorporated, until the displayed concentration of the measuring device reaches 10%. The above concentration provides reproducible measured values. The above measuring device is set at a measuring particle account number of 25,000 and an aperture diameter of 50 μm. The 50% volume cumulative diameter from the larger value is designated as the volume based radian diameter.

<Average Degree of Circularity of Color Toner Particles>

With regard to each of the toner particles constituting the color toner in the invention, the average value of the degree of circularity (hereinafter referred to as "average degree of circularity") represented by following Formula (3) is preferably from 0.930 to 1.000, and more preferably from 0.950 to 0.995 in view of improvement of the transfer ratio.

Average degree of circularity=Peripheral length of circle obtained from circle equivalent diameter/Peripheral length of particle projection image Formula (3)

It is preferred that the color toner particles, which constitute the color toner in the present invention, have a core-shell structure which is composed of a core comprising a resin and a colorant and a shell comprising a shell layer forming resin (hereinafter also referred to as "shell resin") containing substantially no dyes, which cover the circumferential surface of the core. In this case, the shell resin differs from the resin constituting the core (hereinafter also referred to as "core resin"). The color toner particles having the core-shell structure provide high production stability and high storage stability.

The color toner particles having the above core-shell structure may be those in which the shell completely or partly covers the core. Further, the toner particles may have a structure in which a part of the shell resin constituting the shell forms domains in the core. Further, the shell may be a multi-layered structure of at least two layers composed of resins which differ in composition.

<Manufacturing Method of Color Toner>

As methods to manufacture the color toner in the present invention, there are mentioned a kneading-pulverizing method, a suspension polymerization method, an emulsion polymerization method, an emulsion polymerization aggregation method, a mini-emulsion polymerization aggregation method, and an encapsulation method, as well as known methods. A method to manufacture a color toner is preferably an emulsion polymerization aggregation method in view of production cost and production stability, since it is necessary to obtain a color toner composed of particles with a reduced particle diameter to achieve high image quality. The emulsion polymerization aggregation method is a method to produce color toner particles as follows. A dispersion of particles composed of resins produced by an emulsion polymerization method (hereinafter also referred to as "resin particles") is blended with a dispersion of other color toner particle-constituting components such as colorant particles, and aggregation is slowly carried out while balancing the repulsive forces of particle surfaces due to pH control and aggregating forces due to addition of coagulants composed of electrolytes, wherein association is carried out while controlling the average particle diameter and the particle size distribution and heating and stirring is simultaneously carried out to cause fusion among particles and control the particle shape. Thus, color toner particles are obtained.

When the emulsion polymerization aggregation method is employed as a method to produce a color toner, the resulting resin particles may be comprised of at least two layers containing resins differing in composition. In such a case, it is possible to employ a method in which polymerization initiators and polymerizable monomers are added to a first resin particle dispersion prepared by an emulsion polymerization process (a first stage polymerization) based on a conventional method, and the resulting mixture is subjected to a polymerization process (a second stage polymerization).

Further, the manufacturing method of the color toner particles of the core-shell structure will be detailed later. Firstly, core is prepared via association, aggregation and fusion of core resin particles and colorant particles. Subsequently, shell resin particles to form a shell are added to the core particle dispersion so that the shell resin particles are aggregated and fused onto the surface of the core particles to form a shell layer which covers the core particle surface.

The shape of core particles constituting color toner particles of the core-shell structure can be adjusted, for example, via control of heating temperature during the aggregation-fusion process, or heating temperature or heating duration during the first ripening process. Specifically, the control of heating duration during the first ripening process can assuredly regulate a degree of circularity of associated particles.

With respect to the above core particles, a salting-out/fusing method described below for carrying out salting-out/fusion is preferably applied to colorant particles and core resin particles, which are obtained by mechanically dispersing polymerizable monomers for a core resin in the core particles in an aqueous medium to form monomer particles, and subjecting the monomer particles to a mini-emulsion polymerization method.

(Resins)

When color toner particles constituting the color toner in the invention are manufactured via, for example, a pulverization method or a dissolution suspension method, preferred resins to constitute the color toner include vinyl based resins such as styrene resins, (meth)acryl resins, styrene-(meth) acryl copolymer resins or olefin resins, and known resins such as polyester resins, polyamide resins, polycarbonate resins, polyether resins, polyvinyl acetate resins, polysulfone, epoxy resins, polyurethane resins, or urea resins.

Further, when the color toner particles in the invention are manufactured by, for example, a suspension polymerization method, a mini-emulsion polymerization aggregation method or an emulsion polymerization aggregation method, examples of polymerizable monomers for the resin constituting the color toner include vinyl monomers listed below: styrene or its derivatives such as styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, or p-n-decylstyrene or p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, dimethylaminoethyl methacrylate or dimethylaminoethyl methacrylate; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate or phenyl acrylate; olefins such as ethylene, propylene or isobutylene; vinyl esters such as vinyl propionate, vinyl acetate or vinyl benzoate; vinyl ethers such as vinyl methyl ether or vinyl methyl ether; vinyl ketones such as vinyl methyl ketone, vinyl ethyl ketone or vinyl hexyl ketone; N-vinyl compounds such as N-vinylcarbazole, N-vinylindole or N-vinylpyrrolidone; and acrylic acid or methacrylic acid derivatives such as acrylonitrile, methacrylonitrile or acrylamide. These vinyl monomers may be employed alone or as an admixture of two or more kinds thereof.

Further, it is preferred that a polymerizable monomer having an ionic dissociating group is employed in combination. The polymerizable monomer having an ionic dissociating group is one having a substituent such as a carboxyl group, a subtonic acid group or a phosphoric acid group. Typical examples thereof include acrylic acid, methacrylic acid, maleic acid, itaconic acid, cinnamic acid, fumaric acid, monoalkyl maleate, monoalkyl itaconate, styrenesulfonic acid, allylsulfonic succinic acid, 2-acrylamido-2-methylpropanesulfonic acid, an acid phosphoxyethyl methacrylate, and 3-chloro-2-acid phosphoxypropyl methacrylate.

It is also possible to manufacture resins with a crosslinking structure, employing polyfunctional vinyl monomers such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate or neopentyl glycol diacrylate. When the color toner particles are of a core-shell structure, styrene-acryl resins are preferred as the core resin and the shell resin. The glass transition temperature (Tg) of the core resin is preferably lower than that of the shell resin.

When the core resins are composed of copolymers, the polymerizable monomers for preparing the copolymers are preferably those such as propyl acrylate, propyl methacrylate, butyl acrylate, butyl methacrylate, 2-ethylhexyl acrylate and 2-ethylhexyl methacrylate, which provide a low glass transition temperature (Tg) of the resulting copolymers.

The copolymerization ratio of the above polymerizable monomers in the copolymer for the core is from 8 to 80% by weight and more preferably from 9 to 70% by weight, based on the total monomers constituting the copolymer.

Besides the typical examples listed above of the polymerizable monomers, polymerizable monomers used may be in the form of acid anhydride or a vinyl carboxylic acid metal salt.

When the shell resins are composed of copolymers, the polymerizable monomers for preparing the copolymers are preferably those such as styrene, methyl methacrylate or methacrylic acid, which provide a high glass transition temperature (Tg) of the resulting copolymers.

The copolymerization ratio of such polymerizable monomers in the copolymer for the shell is from 8 to 80% by weight and preferably from 9 to 70% by weight, based on the total monomers constituting the copolymer.

Besides the typical examples listed above of the polymerizable monomers, polymerizable monomers used may be in the form of acid anhydride or a vinyl carboxylic acid metal salt.

When the color toner manufactured for example, by an emulsion polymerization method, an emulsion polymerization aggregation method, or a mini-emulsion polymerization aggregation method is in the core-shell structure, the molecular weight of the resins which form core particles and the shell each constituting the color toner particles, is preferably within the following range.

It is preferred that the weight average molecular weight (Mw) of a resin constituting the core particles is in the range of from 5,000 to 30,000, and the weight average molecular weight (Mw) of a resin constituting the shell is in the range of from 10,000 to 80,000, each determined according to gel permeation chromatography (GCP) of the THF solubles. Further, it is more preferred that a resin constituting core particles and a resin constituting the shell has a weight average molecular weight (Mw) in the range of from 15,000 to 28,000, and a weight average molecular weight (Mw) in the range of from 10,000 to 50,000, respectively.

Further, the glass transition temperature (Tg) of the resins constituting the core particles is preferably from 10 to 50° C., and more preferably from 25 to 48° C., while the glass transition temperature (Tg) of the resins constituting the shell is preferably from 38 to 64° C., and more preferably from 40 to 54° C.

On the other hand, when the color toner in the invention is not in the core-shell structure, the number average molecular weight (Mn) of the resin constituting the color toner is preferably from 3,000 to 6,000, and more preferably from 3,500 to 5,500, determined by gel permeation chromatography (GCP) of the THF solubles, and a ratio Mw/Mn of average molecular weight (Mw) to number average molecular weight (Mn) is from 2.0 to 6.0, and preferably from 2.5 to 5.5, and the glass transition temperature (Tg) of the resin is from 50 to 70° C., and preferably from 55 to 70° C.

Measurement of molecular weight according to GPC is conducted as follows. Using an apparatus HLC-8220 (produced by TOSOH CORP.) and a column TSK guard column+ TSK gel Super HZM-M3 (produced by TOSOH CORP.), THF as a carrier solvent is fed at a flow rate of 0.2 ml/min, while maintaining a column temperature of 40° C. A sample is dissolved in THF at room temperature so as to have a concentration of 1 mg/ml, while dispersing for 5 min by using an ultrasonic dispersing machine and then filtered by a membrane filter of 0.2 μm pore size to obtain a sample solution. Then, 10 μl of this sample solution is injected with carrier gas into the GPC and is detected by a refractive index detector (RI detector). In the molecular weight measurement of a sample, the molecular weight distribution of the sample is calculated using a calibration curve prepared by using monodisperse polystyrene standard particles. At least 10 standard polystyrenes are preferably used for the calibration curve, employing standard polystyrene samples produced by Pressure Chemicals Co., having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$.

Further, the glass transition temperature (Tg) of resins is determined employing a differential scanning calorimeter "DSC-7" (also produced by Perkin-Elmer), and a thermal analyzer controller "TAC7/DX" (produced by Perkin-Elmer). The measurement of the glass transition temperature (Tg) is conducted as follows. A color toner of 4.5 mg is precisely weighed, sealed into an aluminum pan (KIT NO. 0219-0041) and set into a DSC-7 sample holder. An empty aluminum pan is used as a reference. The temperature was controlled through a mode of heat-cool-heat at a temperature-raising rate of 10° C./min and a temperature-lowering rate of 10° C./min in the range of 0 to 200° C. Data are recorded during the 2nd heating, and an extension line from the baseline prior to the initial rise of the first endothermic peak and a tangent line exhibiting the maximum slope between the initial rise and the peak are drawn and the intersection of both lines is defined as the glass transition point (Tg). The 1st heat was maintained at 200° C. for 5 min.

Further, the softening point of the resin of the color toner is that providing the color toner in the invention having a softening point falling within the above range.

The resin content of the color toner in the invention is preferably from 60 to 95% by weight, and more preferably from 70 to 90% by weight.

The color toner in the present invention, for example, a color toner of a core-shell structure, is produced according to a process comprising the following step: (1) a colorant particle dispersion preparation step which prepares a colorant particle dispersion in which colorants are dispersed in the form of particles; (2-1) a core resin particle polymerization step in which resin particles composed of resins and optionally a releasing agent and a charge control agent is prepared, followed by preparation of dispersion of the resin particles; (2-2) a shell resin particle polymerization step in which resin particles are prepared followed by preparation of a dispersion of the particles; (3) an aggregation fusion step which forms associated particles employed as core particles by aggregating and fusing core resin particles and colorant particles in an aqueous medium; (4) a first ripening step in which core particles are prepared by ripening the associated particles employing heat energy to control the shape; (5) a shell-forming step in which particles of core-shell structure are prepared by adding shell resin particles for a shell layer to the core particle dispersion so that the shell resin particles are aggregated and fused onto the surface of the core particles; (6) a second ripening step in which colored particles of core-shell structure are prepared by ripening the particles of core-shell structure employing heat energy to control the shape; (7) a filtration and washing step in which the colored particles are subjected to solid-liquid separation from the cooled colored particle dispersion (an aqueous medium) and surface active agents are removed from the resulting colored particles; and (8) a drying step in which the washed colored particles were dried. If desired, (9) an external agent treatment step may be carried out after the drying step in which color toner particles are prepared by adding external agents to the dried colored particles.

Next, a process of manufacturing the yellow toner of core-shell structure will be explained.

(1) Colorant Particle Dispersion Preparation Step

In this step, colorants are added to an aqueous media and the resulting mixture is dispersed in a dispersing machine, whereby a colorant particle dispersion is prepared in which the colorants are dispersed in the form of particles. Specifically, as detailed later, dispersion of the colorants is carried out in an aqueous medium in which the concentration of surface active agents is adjusted to be at least the critical micelle concentration (CMC). A dispersing machine employed for dispersion are not specifically limited, but is preferably an ultrasonic homogenizer, a mechanical homogenizer, a pressure homogenizer such as a Manton-Gaulin, or a medium homogenizer such as a sand grinder, a Getzmann mill or a diamond fine mill.

The dispersion diameter of the colorant particles in the colorant particle dispersion is preferably from 40 to 200 nm in terms of volume based median diameter.

(2-1) Core Resin Particle Polymerization Step

In this step, polymerization step is carried out in which a dispersion of resin particles composed of core resin, optionally containing a releasing agent or a charge control agent, is prepared.

One preferred example of the polymerization step is as follows. A polymerizable monomer solution, containing optionally a releasing agent or a charge control agent, is added to an aqueous medium containing a surfactant at a concentration of at most the critical micelle concentration (CMC). Subsequently, the resulting mixture is subjected to mechanical energy application to form droplets, and added with a water soluble polymerization initiator, followed by polymerization reaction within the droplets. In the meantime, an oil-soluble polymerization initiator may be incorporated within the above droplet. In this process, it is essential to carry out enforced emulsification (formation of droplets) via application of mechanical energy. As such a mechanical energy application means, there are mentioned those such as a homomixer, an ultrasonic homogenizer and a Manton-Gaulin homogenizer, which provide strong agitation or ultrasonic vibration energy.

(Surfactant)

Next, a surfactant will be explained which is employed in the color particle dispersion or in the aqueous medium employing in polymerization carried out for preparation of core resin particles.

The above surfactant is not specifically limited, but preferred examples thereof include ionic surfactants such as sulfonic acid salts (sodium dodecylbenzenesulfonate, and sodium arylalkyl polyethersulfonate); sulfuric acid ester salts (sodium dodecylsulfate, sodium tetradecylsulfate, sodium pentadecylsulfate, and sodium octylsulfate); and fatty acid salts (sodium oleate, sodium laureate, sodium caprate, sodium caprylate, sodium caproate, potassium stearate, and calcium oleate). Further employable are nonionic surfactants such as polyethylene oxide, polypropylene oxide, a combination of polypropylene oxide with polyethylene oxide, esters of polyethylene glycol with higher fatty acids, alkylphenol polyethylene oxide, esters of fatty acids with polyethylene glycol, esters of higher fatty acids with polypropylene oxide or sorbitan esters.

Next, a polymerization initiator, a chain transfer agent, a releasing agent or a charge control agent will be explained which is employed in polymerization carried out for preparation of core resin particles, (Polymerization Initiator)

As the above water-soluble polymerization initiator, there are mentioned persulfates such as potassium persulfate or ammonium persulfate, azobisaminodipropane acetate, azobiscyanovaleric acid and its salts, and hydrogen peroxide.

As oil-soluble radical polymerization initiators, there are mentioned azo or diazo polymerization initiators such as 2,2'-azobis-(2,4-dimethylvaleronitrile), 2,2'-azobisbutyronitrile, 1,1'-azobis(cyclohexane-1-carbonitrile), 2,2'-azobis-4-methoxy-2,4-dimethylvaleronitrile or azobisisobutyronitrile, and peroxide polymerization initiators and polymer initiators having a peroxide moiety in the side chain such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane of tris-(t-butylperoxy) triazine.

(Chain Transfer Agent)

In this polymerization step, a chain transfer agent generally employed can be employed to regulate the molecular weight of the core resins obtained by polymerization.

A Chain transfer agent is not specifically limited, but typical examples thereof include mercaptans such as n-octylmercaptan, n-decylmercaptan or tert-dodecylmercaptan, n-octyl-3-mercaptopropionic acid ester, terpinolene and α-methylstyrene dimers.

(Releasing Agent)

A releasing agent, which contributes to prevention of offsetting phenomena, may be contained in color toner particles constituting the color toner in the invention. A releasing agent is not specifically limited but typical examples thereof include polyethylene wax, oxidation polyethylene wax, polypropylene wax, oxidation polypropylene wax, carnauba wax, sazol wax, rice wax and candelilla wax.

The content of the releasing agent in the color toner particles is generally from 0.5 to 5 parts by weight, and more preferably from 1 to 3 parts by weight with respect to 100 parts by weight of resins. The above content range of the releasing agent provides color toner with sufficient offset minimizing effect, high transparency and high color reproduction.

(Charge Control Agent)

A charge control agent may be contained in color toner particles constituting the color toner in the invention. As the charge control agent, various compounds known in the art can be employed.

In this step, those containing colorants may be manufactured as core resin particles. The core resin particles colored with the colorants can be prepared by polymerization of a polymerizable monomer composition containing colorants. When core resin particles having been colored with colorants are employed, colored core particles can be prepared by aggregating the above colored core resin particles in (3) an aggregation and fusion step described later, without carrying out the colorant particle dispersion preparation step in (1) above. (2-2) Shell Resin Particle Polymerization Step In this step, a dispersion of shell resin particles composed of shell resins is prepared via polymerization in the same manner as the core resin particle polymerization step in item (2-1) above.

(3) Aggregation and Fusion Step

This step is one which forms associated particles to be modified to core particles via aggregating and fusing core resin particles and colorant particles in an aqueous medium. Preferred as an aggregation and fusion method in this step is a salting-out/fusion step, employing the colorant particles prepared via the colorant particle dispersion preparation step of (1) or the core resin particles prepared via the core resin particle polymerization step of (2-1). Further, in the above aggregation and fusion step, it is also possible to aggregate and fuse internal additive particles such as releasing agent particles or charge control agent particles together with core resin particles and colorant particles.

"Salting-out/fusion" herein referred to is a step in which aggregation is carried out along with fusion, and when particles grow to a predetermined particle diameter, particle growth is terminated via addition of an aggregation termination agent, optionally followed by heat application to control the particle shape.

A salting-out/fusion method is as follows. Salting-out agents such as alkaline metal salts, alkaline earth metal salts, and trivalent salts are added at a concentration exceeding the critical aggregation concentration to an aqueous medium in which core resin particles and colorant particles are present and heated to at least the glass transition temperature of the above core resin particles and also to at least melting peak temperature (° C.) of the core resin particles and colorant particles, whereby salting-out and fusion are simultaneously carried out. With regard to alkali metal salts and alkali earth metal salts as a salting-out agent, the alkali metals include lithium, potassium and sodium; while the alkali earth metals are magnesium, calcium, strontium, and barium. Of these, preferably listed are potassium, sodium, magnesium, calcium, and barium.

When the aggregation and fusion step is carried out, employing the salting-out/fusion method, it is preferred that the standby duration after addition of a salting-out agent is as short as possible. The reasons are unclear. The aggregation state of particles varies depending on the standby duration after salting-out, whereby problems occur in which the particle size distribution becomes unstable and the surface characteristics of fused particles fluctuate. Further, it is essential that the temperature during addition of a salting-out agent is at most the glass transition temperature of core resin particles. The reasons are that when the temperature during addition of a salting-out agent is not less than the glass transition temperature of core resin particles, salting-out/fusion of the resin particles rapidly proceeds, which makes it difficult to control the particle diameter, whereby problem occurs that particles of a relatively large diameter are formed. The addition temperature may be acceptable when it is at most the glass transition temperature of the resins, and is generally from 5 to 55° C., and preferably from 10 to 45° C.

Further, a salting-out agent is added at a temperature not more than the glass transition temperature of the core resin particles. Thereafter, the temperature is elevated as soon as possible, to not less than the glass transition temperature of the core resin particles and not less than the melt peak temperature (° C.) of the core resin particles and the colorant particles. The time taken to elevate to that temperature is preferably less than one hour. Further, though it is necessary to rapidly elevate the temperature, the temperature elevation rate is preferably not less than 0.25° C./minute. The upper limit is not clear. However, when the temperature elevates instantaneously, salting-out rapidly proceeds whereby problems occur that it is difficult to control the particle diameter. Thus, the temperature elevation rate is preferably not more than 5° C./minute.

Employing the above salting-out/fusion method, a dispersion of associated particles (core particles) is obtained via salting-out/fusion of core resin particles and any arbitrary particles.

"Aqueous medium" herein refers to a medium composed of from 50 to 100% by weight of water and from 0 to 50% by weight of water-soluble organic solvents. The water-soluble organic solvents include methanol, ethanol, isopropanol, butanol, acetone, methyl ethyl ketone, and tetrahydrofuran. Of these, preferred are alcohol based organic solvents which do not dissolve the resulting resins.

(4) First Ripening Step

In this step, the associated particles are subjected to ripening treatment via heat energy.

Further, by controlling heating temperature in the aggregation and fusion step, and particularly heating temperature and period in the first ripening step, the resulting core particles can be adjusted so that the surface of the core particles with a constant diameter and a narrow diameter distribution is smooth and the uniform. Specifically, relatively low heating temperature in the aggregation and fusion step restrains fusion of the core resin particles and promotes uniformity of the core resin particles, and a relatively low heating temperature and a relatively long ripening period in the first ripening step promote uniformity of the core particle surface.

(5) Shell Formation Step

In the shell forming step, a shell resin particle dispersion is added to a core particle dispersion, so that the shell resin particles are aggregated and fused onto the surface of the core particles, whereby the surface of the core particles is covered with the shell resin particles to form particles having a core-shell structure.

The shell formation step is preferred to provide both low temperature fixability and thermal stability. Further, when a color image is to be formed, the shell formation step provides a secondary color image with high color reproduction, which is preferred.

Specifically, the shell resin particles are added to the core particle dispersion while maintaining at the heating temperature during the aggregation and fusion step and during the first ripening step, and heating and stirring are continued, so that the surface of the core particles is slowly covered with the shell resin particles over several hours. Thus, particles of a core-shell structure are obtained. The heating and stirring period is preferably from 1 to 7 hours, and more preferably from 3 to 5 hours.

(6) Second Ripening Step

When the diameter of particles of the core-shell structure reaches the predetermined value in the shell formation step, particle growth is terminated by the addition of a termination agent such as sodium chloride. Thereafter, heating and stirring are continued over several hours to fuse the shell resin particles covering the core particles, whereby the thickness of the layer formed from the shell resin particles, which cover the surface of the core particles, is regulated to 100 to 300 nm. Thus, resin particles are fusion-adhered onto the core particle surface, whereby rounded colored particles of uniform shape are formed.

In the manufacturing process of the color toner in the present invention, it is possible to control the shape of colored particles to be spherical by setting the period of the second ripening step to be relatively long or by setting the ripening temperature to be relatively high.

(7) Filtration and Washing Step

In this step, initially, the above colored particle dispersion is cooled. It is preferred that cooling is carried out at a cooling rate of 1-20° C./minute. The cooling method is not specifically limited, and there are, for example, a method in which cooling is carried out via introduction of a cooling medium from the exterior of the reaction vessel and a method in which cooling is carried out via direct charging of cooled water into the reaction system.

Subsequently, the colored particle dispersion which has been cooled to a predetermined temperature is subjected to solid/liquid separation to obtain the toner cake. Thereafter, washing step is carried out in which adhered materials such as a surfactant or a salting-out agent are removed from the toner cake (being an aggregate prepared by aggregating the colored particles in a wet state to be in the form of cake). The above filtration methods are not particularly limited, and include a centrifugal separation method, a vacuum filtration method which is carried out employing a Buchner funnel and a filtration method which is carried out employing a filter press.

(8) Drying Step

In this step, the washed color toner cake is dried to obtain dry colored particles. Driers employed in this step include a spray driers a vacuum-freeze drier and a reduced-pressure drier. A static tray drier, a portable type tray drier, a fluidized-bed drier, a rotary drier or an agitation type drier is preferably employed. The moisture content in the dried colored particles is preferably at most 5% by weight, and more preferably at most 2% by weight. Meanwhile, when dried colored particles are aggregated via a weak mutual attraction force, the aggregates may be pulverized. As a pulverizing device, a mechanically pulverizing device such as a jet mill, a Henschel mixer, a coffee mill or a food processor is employed.

(9) External Addition Step

The colored particles, which constitute the color toner in the invention, may be employed as the color toner particles without any modification. However, to improve fluidity, charging properties and cleaning properties, the colored particles can be added with a so-called external additive. The external additives are not specifically limited, and various inorganic and organic particles and aliphatic metal salts can be employed as the external additives.

The inorganic particles are preferably inorganic oxide particles such as silica, titania or alumina, which may be subjected to hydrophobic treatment employing silane coupling agents or titanium coupling agents.

As the organic particles, spherical ones having a number average primary particle diameter of about 10 to about 2,000 nm can be employed. Examples of the organic particles include those composed of polystyrene, polymethyl methacrylate or a styrene-methyl methacrylate copolymer.

The content of these external additives in the color toner is from 0.1 to 5.0% by weight, and preferably from 0.5 to 4.0% by weight. Further, the external additives may be employed as an admixture of two or more kinds thereof.

(Recording Materials)

Recording materials, on which images are formed, via the yellow toner of the present invention, are supports carrying yellow toner images. Specific examples include, but not are limited to, various types of paper such as plain paper from thin paper to heavy paper, quality paper, coated paper such as art paper or coated paper, commercial Japanese paper and post-card paper, OHP plastic film; or fabric.

(Developers)

The color toner used in the invention may be employed as a non-magnetic single component developer, but may also be employed as a double component developer after being blended with carriers. When the yellow toner of the present invention is employed as a double component developer, magnetic particles are usable as a carrier, which are composed of the materials known in the art such as a metal of iron, ferrite or magnetite, as well as an alloy of the above metal with aluminum or lead. Of these, ferrite particles are particularly preferred. Further employed as a carrier may be a coated carrier prepared by covering the surface of magnetic particles with a resin, and a binder type carrier prepared by dispersing magnetic powder in a binder resin.

A covering resin constituting the coated carrier is not particularly limited, and examples thereof include olefin resins, styrene resins, styrene-acryl resins, silicone resins, polyesters and fluorine-containing resins. Further, a resin constituting a resin dispersion type carrier is not particularly limited, and those known in the art are usable, which include, for example, styrene-acryl resins, polyester resins, fluorine-containing resins and phenol resins.

The volume based median diameter of a carrier is preferably from 20 to 100 μm, and more preferably from 20 to 60 μm, since a high quality image is obtained and carrier for is minimized. The volume based median diameter of a carrier is determined, employing a laser diffraction type particle size distribution meter "HELOS" (produced by SYMPATEC Co.) as a representative meter.

In view of spent resistance, preferred carriers are coated carriers, which employ, as a coating resin, silicone resins, copolymer resins (graft resins) of organopolysiloxane with vinyl monomers or polyester resins. In view of durability, stability against environment, and spent resistance, carriers are especially preferred which are covered with a resin prepared by reacting a copolymer (or graft resin) of organopolysiloxane and vinyl monomers with isocyanate. The vinyl monomers constituting the above coated carrier are those having a substituent such as a hydroxyl group which is capable of reacting with an isocyanate.

Next, one example of an image formation apparatus realizing a full color image formation method in the invention will be explained. FIG. 1 is a schematic view of one example of an image formation apparatus which can form a full color image with a two-component developer.

In FIG. 1, 1Y, 1M, 1C and 1K each designate a photoreceptor; 4Y, 4M, 4C and 4K each designate a developing device (a developing means); 5Y, 5M, 5C and 5K each designate a primary transfer roller as a primary transfer means; 5A designates a secondary transfer roller as a secondary transfer means; 6Y, 6M, 6C and 6K each designate a cleaning means; the numeral 7 designates an intermediate transfer unit; the numeral 24 designates a thermal roll fixing device; and the numeral 70 designates an intermediate transfer material.

This image formation apparatus is called a tandem color image formation apparatus, which is composed of a housing 8 comprising plural image formation sections 10Y, 10M, 10C and 10D and an endless belt intermediate transfer material unit 7 as a transfer section, a paper feeding and conveying means 21 to convey a recording material P, and a heat roll fixing device 24 as a fixing means. A reading device SC for reading an original is disposed in the upper section of the image formation apparatus body A. The housing 8 is disposed in the image formation apparatus body A so that it can be pulled out from the image formation apparatus body A through supporting rails 82L and 82R.

Image formation section 10Y to form a yellow image as one of a different color toner image formed on the respective photoreceptors comprises a drum-shaped photoreceptor 1Y as a first photoreceptor and disposed around the photoreceptor 1Y, a charging means 2Y, an exposure means 3Y, a developing means 4Y, a primary transfer roller 5Y as a primary transfer means and a cleaning means 6Y. Image formation section 10M to form a magenta image as one of another different color toner image comprises a drum-shaped photoreceptor 1M as a first photoreceptor and disposed around the photoreceptor 1M, a charging means 2M, an exposure means 3M, a developing means 4M, a primary transfer roller 5M as a primary transfer means and a cleaning means 6M. Image formation section 10C to form a magenta image as one of still another different color toner image comprises a drum-shaped photoreceptor 1C as a first photoreceptor and disposed around the photoreceptor 1C, a charging means 2C, an exposure means 3C, a developing means 4C, a primary transfer roller 5C as a primary transfer means and a cleaning means 6C.

Image formation section 10K to form a black image as one of still further another different color toner image comprises a drum-shaped photoreceptor 1K as a first photoreceptor and disposed around the photoreceptor 1K, a charging means 2K, an exposure means 3K, a developing means 4K, a primary transfer roller 5K as a primary transfer means and a cleaning means 6K.

An endless belt intermediate transfer unit 7, which is turned by plural rollers 71, 72, 73, 74, 76 and 77, comprises an endless belt intermediate transfer material 70 as a second image carrier in the endless belt form, which is pivotably supported.

The individual color images formed in image formation sections 10Y, 10M, 10C and 10K are successively transferred onto the rotating endless belt intermediate transfer material 70 by primary transfer rollers 5Y, 5M, 5C and 5K, respectively, to form a composite color image. A recording member P such as paper or the like as a transfer material housed in paper feed cassette 20 is fed by a paper feed and conveyance means 21 and conveyed to a secondary transfer roller 5A through plural intermediate rollers 22A, 22B, 22C and 22D and a resist roller 23, where color images are transferred together on a recording material P. The recording material P with the transferred color images is fixed by a heat-roll type fixing device 24, nipped by a paper discharge roller 25, and put onto a paper discharge tray 26 outside a machine.

After a color image is transferred onto a recording material P by a secondary transfer roller 5A, any residual toner which remains on the endless belt intermediate transfer material 70 from which the recording material P is separated is removed by a cleaning means 6A.

During image formation, the primary transfer roller 5K is always in contact with the photoreceptor 1K. Other primary rollers 5Y, 5M and 5C are brought into contact with the photoreceptors 1Y, 1M and 1C, respectively, only at the time when color images are formed on the photoreceptors 1Y, 1M and 1C.

The secondary transfer roller 5A is brought into contact with the endless belt intermediate transfer material 70 only when secondary transfer to recording material P is carried out.

Thus, toner images are formed on photoreceptors 1Y, 1M, 1C and 1K, through electrostatic-charging, exposure and development. The resulting toner images having a different color are superimposed on the endless belt intermediate transfer material 70, transferred together onto recording member P and fixed by compression and heating in the heat-roll type fixing device 24. After completion of transferring a toner image to recording member P, any toner remained on the photoreceptors 1Y, 1M, 1C and 1K is removed by cleaning device 6A, and then the foregoing process including electrostatic-charging, exposure and development is repeated to perform a subsequent image formation.

When the toner of the invention is used as a non-magnetic single-component developer for image formation, the two-component developing means are changed to a nonmagnetic single-component developing means.

The fixing method is not specifically limited, and may be any fixing method. There are, for example, a method employing a heat roller and a pressure roller, a method employing a heat roller and a pressure belt, a method employing a heat belt and a pressure roller, and a method employing a heat belt and a pressure belt. As heating methods, any known heating methods such as a method employing a halogen lamp and a method employing IH may be used.

EXAMPLES

The embodiments of the invention will be explained employing examples, but the invention is by no means limited to these.

The volume-based median diameter of yellow colorant particles was measured under the following conditions using MICROTRAC UPA-150 (produced by HONEYWELL Corp.).

[Conditions]
Transparency: Yes
Refractive Index: 159
Particle Density: 1.05 g/cm$^3$
Spherical Particles: Yes
Solvent Conditions
Refractive Index: 1.33
Viscosity: High (temp) $0.797\times10^3$ Pa·S
Low (temp) $1.002\times10^{-3}$ Pa·S

| | |
|---|---|
| C.I. Pigment Yellow 74 | 22.5 weight parts |
| C.I. Pigment Yellow 139 | 2.5 weight parts |

The resulting mixture was dispersed using CLEAR MIX W-Motion CLM-0.8 (produced by M Technique Co.) to obtain Yellow Colorant Particle Dispersion 1 containing colorant particles with a volume-based median diameter of 126 nm.

(1) Preparation of Yellow Colorant Particle Dispersions 2 through 25

Yellow Colorant Particle Dispersions 2 through 25 were prepared in the same manner as Yellow Colorant Particle Dispersion 1, except that kinds or added amount of yellow colorants were changed to those as shown in Table 2.

TABLE 2

| Yellow Colorant Particle Dispersion No. | Yellow Colorant Pigment: Y1 Kind | Y1 Adding Amount (Weight Parts) | Y2 Kind | Y2 Adding Amount (Weight Parts) | Weight Ratio Y1:Y2 | Remarks |
|---|---|---|---|---|---|---|
| 1 | P.Y.74 | 22.5 | P.Y.139 | 2.5 | 90:10 | Inv. |
| 2 | P.Y.74 | 17.0 | P.Y.139 | 8.0 | 68:32 | Inv. |
| 3 | P.Y.74 | 15.0 | P.Y.83 | 10.0 | 60:40 | Inv. |
| 4 | P.Y.74 | 20.0 | P.Y.36 | 5.0 | 80:20 | Inv. |
| 5 | P.Y.65 | 23.75 | P.Y.36 | 1.25 | 95:5 | Inv. |
| 6 | P.Y.98 | 22.5 | P.Y.36 | 2.5 | 90:10 | Inv. |
| 7 | P.Y.3 | 22.5 | P.Y.181 | 2.5 | 90:10 | Inv. |
| 8 | P.Y.3 | 17.5 | P.Y.153 | 7.5 | 70:30 | Inv. |
| 9 | P.Y.3 | 23.75 | P.R.9 | 1.25 | 95:5 | Inv. |
| 10 | P.Y.111 | 19.5 | P.Y.153 | 5.5 | 78:22 | Inv. |
| 11 | P.Y.111 | 17.0 | P.Y.153 | 8.0 | 68:32 | Inv. |
| 12 | P.Y.35 | 20.0 | P.Y.36 | 5.0 | 80:20 | Inv. |
| 13 | P.Y.74 | 6.25 | P.Y.36 | 18.75 | 25:75 | Inv. |
| 14 | P.Y.74 | 2.5 | P.Y.36 | 22.5 | 10:90 | Inv. |
| 15 | P.Y.111 | 22.5 | P.Y.153 | 2.5 | 90:10 | Inv. |
| 16 | P.Y.74 | 17.5 | P.Y.110 | 7.5 | 70:30 | Inv. |
| 17 | P.Y.74 | 25.0 | — | — | 100:0 | Comp. |
| 18 | P.Y.74 | 13.75 | P.Y.181 | 11.25 | 55:45 | Comp. |
| 19 | P.Y.35 | 25.0 | — | — | 100:0 | Comp. |
| 20 | P.Y.34 | 25.0 | — | — | 100:0 | Comp. |
| 21 | M.O. | 25.0 | — | — | 100:0 | Comp. |
| 22 | P.Y.35 | 15.0 | P.Y.36 | 10.0 | 60:40 | Inv. |
| 23 | P.Y.3 | 17.5 | P.Y.74 | 7.5 | 70:30 | Inv. |
| 24 | P.Y.3 | 12.5 | P.Y.74 | 12.5 | 50:50 | Inv. |
| 25 | P.Y.74 | 17.5 | P.Y.110 | 7.5 | 70:30 | Comp. |

Inv.: Inventive,
Comp.: Comparative
P.Y.: C.I. Pigment Yellow
P.R.: C.I. Pigment Red
M.O.: Molybdenum Orange 2. Preparation of Yellow Toners 1 through 25

2-1. Preparation of Core Resin Particles

[Preparation of Core Resin Particle A]

Core Resin Particle A was prepared according to the following procedures.

(1) First Polymerization

Into a reaction vessel fitted with a stirrer, a temperature sensor, a condenser and a nitrogen gas-introducing device were introduced 4 weight parts of an anionic surfactant represented by the following formula 1 together with 3040 weight parts of deionized water with stirring under nitrogen atmosphere to prepare an aqueous surfactant solution.

$$C_{10}H_{21}(OCH_2CH_2)_2SO_3Na \qquad \text{Formula 1}$$

A polymerization initiator solution, in which 10 weight parts of potassium persulfate (KPS) were dissolved in 400 weight parts of deionized water, was added to the foregoing aqueous surfactant solution, and heated to 75° C. Then, a mixed monomer solution comprised of the following compounds was dropwise added to the reaction vessel in 1 hour.

| | |
|---|---|
| Styrene | 532 weight parts |
| n-Butyl acrylate | 200 weight parts |
| Methacrylic acid | 68 weight parts |
| n-Octyl mercaptan | 16.4 weight parts |

After completing addition of the mixed monomer solution, the resulting reaction mixture was heated with stirring at 75° C. for 2 hours to undergo polymerization (first polymerization) to obtain a dispersion containing Resin Particle A1 (a Resin Particle A1 dispersion).

(2) Second Polymerization (Formation of Intermediate Layer)

A mixed monomer solution comprised of the following compounds was introduced into a flask fitted with a stirrer.

| | |
|---|---|
| Styrene | 101.1 weight parts |
| n-Butyl acrylate | 62.2 weight parts |
| Methacrylic acid | 12.3 weight parts |
| n-Octyl mercaptan | 1.75 weight parts |

Successively, 93.8 weight parts of paraffin wax HNP-57 (produced Nippon Seiro Co., Ltd.) as a releasing agent were added thereto and heated at 80° C. to prepare a releasing agent-containing monomer solution.

An aqueous surfactant solution was prepared by dissolving 3 weight parts of the anionic surfactant represented by formula 1 above in 1560 weight parts of deionized water and heated at 80° C. The above-obtained Resin Particle A1 dispersion in an amount of 32.8 weight parts (in terms of solid) was added to the resulting aqueous surfactant solution, further added with the releasing agent-containing monomer solution described above, and dispersed for 8 hours in a mechanical disperser CLEARMIX (produced by M Technique Co.) having a circulation path. Thus, an emulsified particle dispersion containing emulsified particles having a dispersion particle size of 340 nm was prepared.

Subsequently, a polymerization initiator solution in which 6 weight parts of potassium persulfate were dissolved in 200 weight parts of deionized water was added to the emulsified particle dispersion obtained above. The resulting mixture was heated at 80° C. for 3 hours to undergo polymerization (second polymerization) to obtain a dispersion containing Resin Particle A2 (a Resin Particle A2 dispersion).

(3) Third Polymerization (Formation of Outer Layer)

A polymerization initiator solution in which 5.45 weight parts of potassium persulfate were dissolved in 220 weight parts of deionized water was added to the Resin Particle A2 dispersion obtained above, and then dropwise added with a mixed monomer solution comprised of the following compounds at 80° C. in one hour.

| | |
|---|---|
| Styrene | 293.8 weight parts |
| n-Butyl acrylate | 154.1 weight parts |
| n-Octyl mercaptan | 7.08 weight parts |

After completion of the addition, the resulting mixture was stirred at 80° C. for additional 2 hours to undergo polymerization (third polymerization). After completion of polymerization, the resulting reaction mixture was cooled to 28° C. to obtain a dispersion containing Core Resin Particle A (a Core Resin Particle A dispersion). The glass transition temperature (Tg) of the Core Resin Particle A prepared in the third polymerization was 28.1° C.

[Preparation of Core Resin Particle B]

(1) First Polymerization (Formation of Nucleus Particles)

A mixture comprised of the following compounds was introduced into a reaction vessel fitted with a stirrer, a temperature sensor, a condenser and a nitrogen gas-introducing device, and heated to 80° C. to obtain a mixed monomer solution.

| | |
|---|---|
| Styrene | 115.9 weight parts |
| n-Butyl acrylate | 47.4 weight parts |
| Methacrylic acid | 12.3 weight parts |
| Paraffin wax HNP-57 (produced Nippon Seiro Co., Ltd.) | 93.8 weight parts |

An aqueous surfactant solution, in which 2.9 weight parts of an anionic surfactant represented by the following formula 2 was dissolved in 1340 weight parts of deionized water, was heated to 80° C., introduced in the reaction vessel above, and mixed with the mixed monomer solution obtained above.

$C_{10}H_{21}(OCH_2CH_2)_2OSO3Na$ Formula 2

Subsequently, the resulting mixture was dispersed for 2 hours in a mechanical disperser CLEARMIX (produced by M Technique Co.) having a circulation path. Thus, an emulsified particle dispersion containing emulsified particles (oil droplets) having a dispersion particle size of 245 nm was prepared.

The particle dispersion was added with 1460 weight parts of deionized water, then mixed with a polymerization initiator solution in which 6.1 weight parts of polymerization initiator (potassium persulfate: KPS) and 1.8 weight parts of n-octylmercaptan were dissolved in 237 weight parts of deionized water, and heated to 80° C. Then, the resulting mixture was stirred at 80° C. for 3 hours to perform a first polymerization to obtain a dispersion containing Resin Particle B1 (a Resin Particle B1 dispersion).

(2) Second Polymerization (Formation of Outer Layer)

Subsequently, a polymerization initiator solution in which 3.8 weight parts of polymerization initiator (potassium persulfate, KPS) were dissolved in 148 weight parts of deionized water was added to the Resin Particle B1 dispersion obtained above, and a mixed monomer solution composed of the following compounds was dropwise added thereto at 80° C. in one hour.

| | |
|---|---|
| Styrene | 300.9 weight parts |
| n-Butyl acrylate | 146.9 weight parts |
| Methacrylic acid | 3 weight parts |
| n-Octyl mercaptan | 4.93 weight parts |

After completion of the addition, the resulting mixture was stirred at 80° C. for additional 2 hours to undergo polymerization (second polymerization). After completion of polymerization, the resulting reaction mixture was cooled to 28° C. to obtain a dispersion containing Core Resin Particle B (a Core Resin Particle B dispersion). The glass transition temperature (Tg) of the Core Resin Particle B in the Core Resin Particle B dispersion obtained in the second polymerization was 36.0° C.

[Preparation of Core Resin Particle C]

Core Resin Particle C was prepared in the same manner as Core Resin Particle B, except that the mixed monomer solution in the first polymerization was changed to that comprised of the following compounds and the polymerization initiator solution in the first polymerization was changed to a polymerization initiator solution in which 6.1 weight parts of a polymerization initiator (potassium persulfate: KPS) and 0.8 weight parts of n-octylmercaptan were dissolved in 237 weight parts of deionized water. The glass transition temperature (Tg) of the Core Resin Particle C was 42.6° C.

| | |
|---|---|
| Styrene | 135.9 weight parts |
| n-Butyl acrylate | 27.4 weight parts |
| methacrylic acid | 12.3 weight parts |

[Preparation of Core Resin Particle D]

(1) First Polymerization (Formation of Nucleus Particle)

Four weight parts of an anionic surfactant represented by formula 2 above were dissolved in 3040 weight parts of deionized water in a reaction vessel fitted with a stirrer, a temperature sensor, a condenser and a nitrogen gas-introducing device while stirring at a stirring speed of 230 rpm under nitrogen atmosphere to prepare an aqueous surfactant solution.

A polymerization initiator solution in which 10 weight parts of potassium persulfate (KPS) were dissolved in 400 weight parts of deionized water was added to the foregoing aqueous surfactant solution, heated to 75° C., then dropwise added in 1 hour with a mixed monomer solution comprised of the following compounds.

| | |
|---|---|
| Styrene | 528 weight parts |
| n-Butyl acrylate | 204 weight parts |
| Methacrylic acid | 68 weight parts |
| n-Octyl-3-mercaptoproionate | 24.4 weight parts |

After completion of the addition, the resulting mixture was stirred at 75° C. for 2 hours to undergo polymerization (first polymerization) to obtain a dispersion containing Resin Particle D1 (a Resin Particle D1 dispersion).

(2) Second Polymerization (Formation of Intermediate Layer)

A mixed monomer solution comprised of the following compounds was introduced into a flask fitted with a stirrer.

| | |
|---|---|
| Styrene | 95 weight parts |
| n-Butyl acrylate | 36 weight parts |
| Methacrylic acid | 9 weight parts |
| n-Octyl-3-mercaptoproionate | 0.69 weight parts |

Successively, 77 weight parts of paraffin wax HNP-57 (produced Nippon Seiro Co., Ltd.) as a releasing agent was added thereto and dissolved with heating at 90° C. to prepare a releasing agent-containing monomer solution.

An aqueous surfactant solution was prepared by dissolving 1 weight part of the anionic surfactant represented by formula 2 above in 1560 weight parts of deionized water and heated at 98° C. The above-obtained Resin Particle D1 dispersion in an amount of 28 weight parts (in terms of solid) was added to the resulting aqueous surfactant solution, further added with the releasing agent-containing monomer solution prepared above, and dispersed for 8 hours in a mechanical disperser CLEARMIX (produced by M Technique Co.) having a circulation path. Thus, an emulsified particle dispersion containing emulsified particles having a dispersion particle size of 284 nm was prepared.

Subsequently, a polymerization initiator solution in which 5 weight parts of potassium persulfate were dissolved in 200 weight parts of deionized water was added to the emulsified particle dispersion obtained above. The resulting mixture was heated at 98° C. for 12 hours to undergo polymerization (second polymerization) to prepare a dispersion containing Resin Particle D2 (a Resin Particle D2 dispersion).

(3) Third Polymerization (Formation of Outer Layer)

A polymerization initiator solution in which 5.8 weight parts of potassium persulfate were dissolved in 265 weight parts of deionized water was added to the Resin Particle D2 dispersion obtained above and was dropwise added with a monomer mixture solution comprised of the following compounds at 80° C. in one hour.

| | |
|---|---|
| Styrene | 242.5 weight parts |
| n-Butyl acrylate | 96.5 weight parts |
| Methacrylic acid | 18 weight parts |
| n-Octyl-3-mercaptoproionate | 8.0 weight parts |

After completion of the addition, the resulting mixture was stirred at 80° C. for additional 2 hours to undergo polymerization (third polymerization). After completion of polymerization, the resulting reaction mixture was cooled to 28° C. to obtain a dispersion containing Core Resin Particle D (a Core Resin Particle D dispersion). The glass transition temperature (Tg) of the Core Resin Particle D in the third resin particle dispersion prepared in the third polymerization was 52.8° C.

[Preparation of Core Resin Particle E]

Core Resin Particle E was prepared in the same manner as Core Resin Particle B, except that the mixed monomer solution in the second polymerization (for formation of an outer layer) was changed to a mixed monomer solution comprised of the following compounds and the polymerization initiator solution in the first polymerization was changed to a polymerization initiator solution in which 5.1 weight parts of a polymerization initiator (potassium persulfate; KPS) were dissolved in 197 weight parts of deionized water. The glass transition temperature (Tg) of the Core Resin Particle E was 9.2° C.

| | |
|---|---|
| Styrene | 135.9 weight parts |
| n-Butyl acrylate | 27.4 weight parts |
| Methacrylic acid | 12.3 weight parts |

2-2. Preparation of Shell Resin Particle 1

A shell resin particle dispersion was prepared in the same manner as Resin Particle A1 dispersion above, except that the mixed monomer solution used in the first polymerization was changed to a mixed monomer solution comprised of the following compounds each in an amount shown below.

| | |
|---|---|
| Styrene | 624 weight parts |
| 2-Ethylhexyl acrylate | 120 weight parts |
| Methacrylic acid | 56 weight parts |
| n-Octyl mercaptan | 16.4 weight parts |

The resin particles in the resulting shell resin particle dispersion were designated as Shell Resin Particle 1. The glass transition temperature (Tg) of the Shell Resin Particle 1 was 62.6° C.

2-3. Preparation of Yellow Toners 1 through 25

[Preparation of Yellow Toner 1]

(1) Formation of Core

Into a reaction vessel fitted with a stirrer, a temperature sensor, a condenser and a nitrogen gas introducing device and stirred was introduced the following composition.

| | |
|---|---|
| Core Resin Particle A dispersion | 420.7 weight parts (in terms of solid) |
| Deionized water | 900 weight parts |
| Yellow Colorant Particle Dispersion 1 | 200 weight parts |

The resulting mixture was adjusted to 30° C. and added with an aqueous 5 mol/L sodium hydroxide solution to give a pH of 8 to 11.

Subsequently, an aqueous solution in which 2 weight parts of magnesium chloride hexahydrate were dissolved in 1000 weight parts of deionized water was added thereto at 30° C. in 10 minutes. After allowed to stand for 3 minutes, the mixture was heated to 65° C. in 60 minutes to perform association of particles. Using Coulter Multisizer III (produced by Beckman Coulter Co.), the particle size of the associated particles in the mixture was measured, and when the associated particles reached a volume-based median diameter of 5.5 μm, the mixture was added with an aqueous solution in which 40.2 weight parts of sodium chloride were dissolved in 1000 weight parts of deionized water to terminate growth of the particles. The resulting mixture was stirred at 70° C. for one hour for ripening treatment to allow fusion to continue, whereby a core dispersion containing Core 1 was prepared. The average circularity of the Core 1 in the core dispersion was 0.912, measured by FPIA 2100 (produced by SISMECS Co. Ltd.).

(2) Formation of Shell

Subsequently, 96 weight parts (in terms of solid) of Shell Resin Particle 1 dispersion were added to the above-obtained core dispersion at 65° C., and an aqueous solution, in which 2 weight parts of magnesium chloride hexahydrate were dissolved in 1000 weight parts of deionized water, was further added thereto in 10 minutes. The resulting mixture was heated to 70° C. (shell formation temperature), then stirred for 1 hour so that the Shell Resin Particle 1 was fusion-adhered onto the surface of the Core 1, and subjected to ripening treatment at 75° C. for 20 minutes to form a shell.

Thereafter, the resulting mixture was added with 40.2 weight parts of sodium chloride, cooled to 30° C. at a cooling rate of 6° C./minute, and filtered off to obtain colored particles. The resulting colored particles were repeatedly washed with 45° C. deionized water, and dried with 40° C. hot air. Thus, Yellow Toner 1 having a shell formed on the core surface was prepared.

[Preparation of Yellow Toners 2 through 25]

Yellow Toners 2 through 25 were prepared in the same manner as in Yellow Toner 1 above, except that Yellow Colorant Particle Dispersion 1 or Core Resin Particle A was replaced with the yellow colorant particle dispersion or the core resin particle as shown in Table 3 below, respectively. Kinds of the yellow colorant particle dispersion and the core resin particle used in each yellow toner, and the glass transition point and weight average molecular weight of the core resin particle are collectively shown in Table 3. Further, the volume based median diameter, the average degree of circularity, the softening point and the reflectance properties of each of Yellow Toners 1 through 25 are collectively shown in Table 4.

TABLE 3

| Yellow Toner No. | Yellow Colorant Particle Dispersion No. | Core Resin Particle No. | Glass Transition Point (° C.) | Weight Average Molecular Weight (Mw) | Remarks |
|---|---|---|---|---|---|
| 1 | 1 | A | 28.1 | 10,600 | Inv. |
| 2 | 2 | A | 28.1 | 10,600 | Inv. |
| 3 | 3 | A | 28.1 | 10,600 | Inv. |
| 4 | 4 | A | 28.1 | 10,600 | Inv. |
| 5 | 5 | A | 28.1 | 10,600 | Inv. |
| 6 | 6 | B | 36.0 | 15,400 | Inv. |
| 7 | 7 | C | 42.6 | 14,200 | Inv. |
| 8 | 8 | B | 36.0 | 15,400 | Inv. |
| 9 | 9 | C | 42.6 | 14,200 | Inv. |
| 10 | 10 | A | 28.1 | 10,600 | Inv. |
| 11 | 11 | A | 28.1 | 10,600 | Inv. |
| 12 | 12 | A | 28.1 | 10,600 | Inv. |
| 13 | 13 | A | 28.1 | 10,600 | Inv. |
| 14 | 14 | A | 28.1 | 10,600 | Inv. |
| 15 | 15 | A | 28.1 | 10,600 | Inv. |
| 16 | 16 | D | 52.8 | 16,000 | Inv. |
| 17 | 17 | A | 28.1 | 10,600 | Comp. |
| 18 | 18 | A | 28.1 | 10,600 | Comp. |
| 19 | 19 | A | 28.1 | 10,600 | Comp. |
| 20 | 20 | A | 28.1 | 10,600 | Comp. |
| 21 | 21 | A | 28.1 | 10,600 | Comp. |
| 22 | 22 | B | 36.0 | 15,400 | Inv. |
| 23 | 23 | C | 42.6 | 14,200 | Inv. |
| 24 | 24 | D | 52.8 | 16,000 | Inv. |
| 25 | 25 | E | 9.2 | 20,100 | Comp. |

Inv.: Inventive,
Comp.: Comparative

3. Preparation of Magenta Toners 1 through 20

(1) Preparation of Magenta Colorant Particle Dispersion 1

Sodium n-dodecylsulfate of 11.5 weight parts was dissolved in 160 weight parts of deionized water to prepare an aqueous surfactant solution. The following magenta colorants were gradually added to this aqueous surfactant solution.

| | |
|---|---|
| Complex compound 1 | 22.5 weight parts |
| C.I. Solvent Red 49 | 2.5 weight parts |

The resulting mixture was subjected to dispersion treatment using CLEAR MIX W-Motion CLM-0.8 (produced by M Technique Co.) to obtain Magenta Colorant Particle Dispersion containing colorant particles with a volume-based median diameter of 126 nm.

(1) Preparation of Magenta Colorant Particle Dispersions 2 through 20

Magenta Colorant Particle Dispersions 2 through 20 were prepared in the same manner as Magenta Colorant Particle Dispersion 1, except that kinds or added amount of the magenta colorants were changed to those as shown in Table 5.

TABLE 4

| Yellow Toner No. | Volume Based Median Diameter (μm) | Average Degree of Circularity | Softening Point (° C.) | Reflectance Properties (Unit: %) $A_{415}+A_{460}$ | $A_{510}-A_{490}$ | $A_{550}-A_{530}$ | $A_{550}$ | Remarks |
|---|---|---|---|---|---|---|---|---|
| 1 | 5.9 | 0.952 | 88 | 14 | 30 | 5 | 80 | Inv. |
| 2 | 5.8 | 0.950 | 88 | 12 | 28 | 14 | 82 | Inv. |
| 3 | 5.9 | 0.954 | 88 | 12 | 28 | 3 | 83 | Inv. |
| 4 | 6.0 | 0.953 | 88 | 24 | 30 | 16 | 82 | Inv. |
| 5 | 5.8 | 0.950 | 88 | 24 | 30 | 2 | 81 | Inv. |
| 6 | 5.8 | 0.954 | 99 | 24 | 30 | 8 | 76 | Inv. |
| 7 | 5.8 | 0.952 | 112 | 3 | 30 | 10 | 78 | Inv. |
| 8 | 5.9 | 0.952 | 99 | 3 | 30 | 16 | 77 | Inv. |
| 9 | 5.9 | 0.951 | 112 | 3 | 20 | 4 | 80 | Inv. |
| 10 | 5.8 | 0.948 | 88 | 13 | 37 | 15 | 76 | Inv. |
| 11 | 5.8 | 0.946 | 88 | 13 | 37 | 15 | 75 | Inv. |
| 12 | 5.9 | 0.950 | 88 | 24 | 40 | 2 | 74 | Inv. |
| 13 | 5.9 | 0.957 | 88 | 24 | 20 | 9 | 77 | Inv. |
| 14 | 6.0 | 0.954 | 88 | 24 | 20 | 16 | 78 | Inv. |
| 15 | 5.8 | 0.953 | 88 | 13 | 37 | 9 | 76 | Inv. |
| 16 | 6.1 | 0.954 | 114 | 26 | 22 | 3 | 80 | Comp. |
| 17 | 5.9 | 0.957 | 88 | 2 | 45 | 3 | 79 | Comp. |
| 18 | 6.0 | 0.956 | 88 | — | 18 | — | 82 | Comp. |
| 19 | 5.8 | 0.956 | 88 | 15 | 17 | 5 | 81 | Comp. |
| 20 | 5.9 | 0.953 | 88 | 3 | 12 | 13 | 82 | Comp. |
| 21 | 5.9 | 0.952 | 88 | 5 | 5 | 4 | 88 | Comp. |
| 22 | 5.8 | 0.957 | 99 | 24 | 40 | 9 | 80 | Inv. |
| 23 | 5.9 | 0.953 | 112 | 3 | 40 | 10 | 82 | Inv. |
| 24 | 5.8 | 0.954 | 114 | 3 | 40 | 16 | 82 | Inv. |
| 25 | 5.9 | 0.956 | 74 | 26 | 38 | 15 | 83 | Comp. |

Inv.: Inventive,
Comp.: Comparative

TABLE 5

| Magenta Colorant Particle Dispersion No. | Magenta Colorant Pigment M1 Kind | M1 Adding Amount (Weight Parts) | M2 Kind | M2 Adding Amount (Weight Parts) | Weight Ratio M1:M2 | Remarks |
|---|---|---|---|---|---|---|
| 1 | C-1 | 22.5 | S.R.49 | 2.5 | 90:10 | Inv. |
| 2 | C-2 | 23.5 | P.R.9 | 8.0 | 75:25 | Inv. |
| 3 | C-2 | 12.5 | P.R.9 | 12.5 | 50:50 | Inv. |
| 4 | C-3 | 20.5 | P.R.9 | 4.5 | 82:18 | Inv. |
| 5 | C-4 | 12.5 | P.R.9 | 12.5 | 50:50 | Inv. |
| 6 | C-1 | 22.5 | S.R.49 | 2.5 | 90:10 | Inv. |
| 7 | C-3 | 7.5 | S.R.49 | 17.5 | 30:70 | Inv. |
| 8 | C-3 | 25.0 | — | — | 100:0 | Inv. |
| 9 | C-1 | 17.5 | P.R.9 | 7.5 | 70:30 | Inv. |
| 10 | C-3 | 12.5 | P.R.9 | 12.5 | 50:50 | Inv. |
| 11 | C-3 | 20.5 | P.R.208 | 4.5 | 82:18 | Inv. |
| 12 | C-4 | 12.5 | P.R.209 | 12.5 | 50:50 | Inv. |
| 13 | C-4 | 20.0 | P.R.209 | 5.0 | 20:80 | Inv. |
| 14 | C-4 | 18.75 | P.R.208 | 6.25 | 75:25 | Inv. |
| 15 | P.R.9 | 25.0 | — | — | 100:0 | Comp. |
| 16 | C-1 | 12.5 | P.R.9 | 12.5 | 50:50 | Inv. |
| 17 | C-1 | 0.75 | P.R.9 | 24.25 | 3:97 | Inv. |
| 18 | P.R.43:3 | 22.5 | P.R.9 | 2.5 | 90:10 | Comp. |
| 19 | P.R.43:3 | 15.0 | P.R.9 | 10.0 | 60:40 | Comp. |
| 20 | P.R.43:3 | 25.0 | — | — | 100:0 | Comp. |

Inv.: Inventive,
Comp.: Comparative
C-1: Complex 1,
C-2: Complex 2,
C-3: Complex 3,
C-4: Complex 4
S.R.: C.I. Solvent Red,
P.R.: C.I. Pigment Red (3) Preparation of Magenta Toners 1 through 20

Magenta Toners 1 through 20 were prepared in the same manner as in Yellow Toner 1 above, except that Yellow Colorant Particle Dispersion 1 or Core Resin Particle A was replaced with the magenta colorant particle dispersion or the core resin particle as shown in Table 6 below, respectively. Kinds of the magenta colorant particle dispersion and the core resin particle used in each magenta toner, and the glass transition point and weight average molecular weight of the core resin particle are collectively shown in Table 6. Further, the volume based median diameter, the average degree of circularity, the softening point and the reflectance properties of each of Magenta Toners 1 through 20 are collectively shown in Table 7.

TABLE 6

| Magenta Toner No. | Magenta Colorant Particle Dispersion No. | Core Resin Particle No. | Glass Transition Point (° C.) | Weight Average Molecular Weight (Mw) | Remarks |
|---|---|---|---|---|---|
| 1 | 1 | A | 28.1 | 10,600 | Inv. |
| 2 | 2 | A | 28.1 | 10,600 | Inv. |
| 3 | 3 | A | 28.1 | 10,600 | Inv. |
| 4 | 4 | A | 28.1 | 10,600 | Inv. |
| 5 | 5 | A | 28.1 | 10,600 | Inv. |
| 6 | 6 | B | 36.0 | 15,400 | Inv. |
| 7 | 7 | C | 42.6 | 14,200 | Inv. |
| 8 | 8 | B | 36.0 | 15,400 | Inv. |
| 9 | 9 | C | 42.6 | 14,200 | Inv. |
| 10 | 10 | A | 28.1 | 10,600 | Inv. |
| 11 | 11 | A | 28.1 | 10,600 | Inv. |
| 12 | 12 | A | 28.1 | 10,600 | Inv. |
| 13 | 13 | A | 28.1 | 10,600 | Inv. |
| 14 | 14 | A | 28.1 | 10,600 | Inv. |
| 15 | 15 | A | 28.1 | 10,600 | Inv. |
| 16 | 16 | D | 52.8 | 16,000 | Inv. |
| 17 | 17 | A | 28.1 | 10,600 | Comp. |
| 18 | 18 | A | 28.1 | 10,600 | Comp. |
| 19 | 19 | A | 28.1 | 10,600 | Comp. |
| 20 | 20 | A | 28.1 | 10,600 | Comp. |

Inv.: Inventive,
Comp.: Comparative

TABLE 7

| Magenta Toner No. | Volume Based Median Diameter (μm) | Average Degree of Circularity | Softening Point (° C.) | Reflectance Properties (Unit: %) $B_{450}-B_{520}$ | $B_{530}+B_{570}$ | $B_{670}-B_{600}$ | $B_{670}$ | Remarks |
|---|---|---|---|---|---|---|---|---|
| 1 | 5.9 | 0.952 | 88 | 55 | 18 | 34 | 90 | Inv. |
| 2 | 5.8 | 0.954 | 88 | 50 | 15 | 49 | 90 | Inv. |
| 3 | 5.8 | 0.954 | 88 | 33 | 7 | 25 | 90 | Inv. |
| 4 | 5.7 | 0.950 | 88 | 48 | 6 | 4 | 90 | Inv. |
| 5 | 5.8 | 0.950 | 88 | 80 | 6 | 5 | 90 | Inv. |
| 6 | 5.9 | 0.954 | 99 | 55 | 18 | 34 | 91 | Inv. |
| 7 | 5.9 | 0.952 | 112 | 54 | 18 | 12 | 91 | Inv. |
| 8 | 5.7 | 0.952 | 99 | 50 | 21 | 1 | 92 | Comp. |
| 9 | 5.9 | 0.951 | 112 | 52 | 7 | 46 | 90 | Inv. |
| 10 | 5.8 | 0.953 | 88 | 48 | 6 | 9 | 90 | Inv. |
| 11 | 5.8 | 0.590 | 88 | 80 | 6 | 5 | 92 | Inv. |
| 12 | 5.7 | 0.954 | 88 | 30 | 14 | 22 | 93 | Inv. |
| 13 | 5.9 | 0.952 | 88 | 30 | 15 | 47 | 93 | Inv. |
| 14 | 5.8 | 0.952 | 88 | 30 | 14 | 5 | 93 | Inv. |
| 15 | 5.9 | 0.953 | 88 | 30 | 26 | 22 | 90 | Comp. |
| 16 | 5.7 | 0.952 | 114 | 33 | 7 | 25 | 90 | Inv. |
| 17 | 5.8 | 0.951 | 88 | 33 | 8 | 45 | 90 | Inv. |
| 18 | 5.7 | 0.948 | 88 | 19 | 8 | 48 | 90 | Comp. |

TABLE 7-continued

| Magenta Toner No. | Volume Based Median Diameter (μm) | Average Degree of Circularity | Softening Point (° C.) | Reflectance Properties (Unit: %) $B_{450}-B_{520}$ | $B_{530}+B_{570}$ | $B_{670}-B_{600}$ | $B_{670}$ | Remarks |
|---|---|---|---|---|---|---|---|---|
| 19 | 5.9 | 0.946 | 88 | 19 | 8 | 6 | 90 | Comp. |
| 20 | 5.7 | 0.950 | 88 | 19 | 24 | 5 | 90 | Comp. |

Inv.: Inventive,

Comp.: Comparative

4. Preparation of Cyan Toners 1 through 13

(1) Preparation of Magenta Colorant Particle Dispersion 1

Sodium n-dodecylsulfate of 11.5 weight parts was dissolved in 160 weight parts of deionized water to prepare an aqueous surfactant solution. The following cyan colorants were gradually added to this aqueous surfactant solution.

| | |
|---|---|
| Cyan Colorant I-1 | 2.5 weight parts |
| Cyan Colorant II-1 | 22.5 weight parts |

The resulting mixture was dispersed using CLEAR MIX W-Motion CLM-0.8 (produced by M Technique Co.) to obtain Cyan Colorant Particle Dispersion 1 containing colorant particles with a volume-based median diameter of 130 nm.

(2) Preparation of Cyan Colorant Particle Dispersions 2 through 13

Cyan Colorant Particle Dispersions 2 through 13 were prepared in the same manner as Cyan Colorant Particle Dispersion 1, except that kinds or added amount of the cyan colorants were changed to those as shown in Table 8.

TABLE 8

| Cyan Colorant Particle Dispersion No. | Cyan Colorant Pigment C1 Kind | C1 Adding Amount (Weight Parts) | C2 Kind | C2 Adding Amount (Weight Parts) | Weight Ratio C1:C2 | Remarks |
|---|---|---|---|---|---|---|
| 1 | I-1 | 2.5 | II-1 | 22.5 | 10:90 | Inv. |
| 2 | I-1 | 22.5 | II-1 | 2.5 | 90:10 | Inv. |
| 3 | I-2 | 15.0 | II-6 | 10.0 | 60:40 | Inv. |
| 4 | I-3 | 20.0 | II-1 | 5.0 | 80:20 | Inv. |
| 5 | I-4 | 23.75 | II-1 | 1.25 | 95:5 | Inv. |
| 6 | I-7 | 22.5 | II-2 | 2.5 | 90:10 | Inv. |
| 7 | I-6 | 22.5 | II-4 | 2.5 | 90:10 | Inv. |
| 8 | I-7 | 25.0 | — | — | 100:0 | Inv. |
| 9 | I-10 | 23.5 | II-3 | 1.25 | 95:5 | Inv. |
| 10 | I-6 | 19.5 | II-5 | 5.5 | 78:22 | Inv. |
| 11 | I-19 | 17.0 | II-1 | 8.0 | 68:32 | Inv. |
| 12 | P.B.15:3 | 100 | — | — | 100:0 | Comp. |
| 13 | P.B.15:3 | 20.0 | II-1 | 5.0 | 80:20 | Comp. |

Inv.: Inventive,

Comp.: Comparative

P.B.15:3: C.I. Pigment Blue 15:3

(3) Preparation of Cyan Toners 1 through 13

Cyan Toners 1 through 13 were prepared in the same manner as in Yellow Toner 1 above, except that Yellow Colorant Particle Dispersion 1 or Core Resin particle A was replaced with the cyan colorant particle dispersion or the core resin particle as shown in Table 8 below, respectively. Kinds of the cyan colorant particle dispersion and the core resin particle used in each cyan toner, and the glass transition point and weight average molecular weight of the core resin particle are collectively shown in Table 9Further, the volume based median diameter, the average degree of circularity, the softening point and the reflectance properties of each of cyan Toners 1 through 13 are collectively shown in Table 10.

TABLE 9

| Cyan Toner No. | Cyan Colorant Particle Dispersion No. | Core Resin Particle No. | Glass Transition Point (° C.) | Weight Average Molecular Weight (Mw) | Remarks |
|---|---|---|---|---|---|
| 1 | 1 | A | 28.1 | 10,600 | Inv. |
| 2 | 2 | A | 28.1 | 10,600 | Inv. |
| 3 | 3 | A | 28.1 | 10,600 | Inv. |
| 4 | 4 | A | 28.1 | 10,600 | Inv. |
| 5 | 5 | A | 28.1 | 10,600 | Inv. |
| 6 | 6 | A | 28.1 | 10,600 | Inv. |
| 7 | 7 | A | 28.1 | 10,600 | Inv. |
| 8 | 8 | B | 36.0 | 15,400 | Inv. |
| 9 | 9 | B | 36.0 | 15,400 | Inv. |
| 10 | 10 | B | 36.0 | 15,400 | Inv. |
| 11 | 11 | B | 36.0 | 15,400 | Inv. |
| 12 | 12 | B | 36.0 | 15,400 | Comp. |
| 13 | 13 | B | 36.0 | 15,400 | Comp. |

Inv.: Inventive,

Comp.: Comparative

TABLE 10

| Cyan Toner No. | Volume Based Median Diameter (μm) | Average Degree of Circularity | Softening Point (° C.) | Reflectance Properties (Unit: %) $C_{480}-C_{450}$ | $C_{550}-C_{570}$ | $C_{570}$ | $C_{620}+C_{650}$ | Remarks |
|---|---|---|---|---|---|---|---|---|
| 1 | 5.9 | 0.952 | 88 | 4 | 20 | 35 | 15 | Inv. |
| 2 | 5.8 | 0.953 | 88 | 7 | 25 | 40 | 20 | Inv. |
| 3 | 5.9 | 0.950 | 88 | 10 | 19 | 38 | 25 | Inv. |
| 4 | 5.7 | 0.952 | 88 | 15 | 16 | 39 | 24 | Inv. |
| 5 | 5.8 | 0.950 | 88 | 12 | 30 | 22 | 28 | Inv. |
| 6 | 5.8 | 0.954 | 88 | 5 | 28 | 28 | 31 | Comp. |
| 7 | 5.8 | 0.951 | 88 | 8 | 31 | 32 | 34 | Comp. |
| 8 | 5.7 | 0.952 | 99 | 11 | 28 | 51 | 22 | Comp. |
| 9 | 5.9 | 0.950 | 99 | 6 | 22 | 47 | 31 | Comp. |
| 10 | 5.8 | 0.952 | 99 | 9 | 24 | 23 | 45 | Comp. |
| 11 | 5.8 | 0.596 | 99 | 13 | 25 | 35 | 29 | Inv. |
| 12 | 5.7 | 0.955 | 99 | 2 | 10 | 11 | 14 | Comp. |
| 13 | 5.7 | 0.955 | 99 | 3 | 14 | 27 | 15 | Comp. |

Inv.: Inventive,
Comp.: Comparative

5. Evaluation 5-1. Preparation of Developers

Yellow Toners 1 through 25 were mixed with silicon resin-covered ferrite carrier with a volume average particle diameter to give a toner content of 6% by weight, whereby two-component developers, Yellow Developers 1 through 25 were prepared. Similarly, Magenta Toners 1 through 20 and Cyan Toners 1 through 13 were mixed with silicon resin-covered ferrite carrier with a volume average particle diameter to give a toner content of 6% by weight, whereby two-component developers, Magenta Developers 1 through 20, and Cyan Developers 1 through 13 were prepared.

5-2. Evaluation

Yellow Developers 1 through 25, Magenta Developers 1 through 20 and Cyan Developers 1 through 13 were appropriately combined to obtain 25 color developer set samples comprised of a yellow developer, a magenta developer and a cyan developer. The combinations are shown in Table 11 described later. The set samples in which all of the yellow developer, magenta developer and cyan developer fall within the claimed scope are inventive set samples 1 through 12, and the set samples in which at least one of the yellow developer, magenta developer and cyan developer falls outside the claimed scope are comparative set samples 1 through 13.

Each of the color developer set samples was loaded in a commercial full color composite printer SITIOS 9331 (produced by Konica Minolta Business Technologies, Inc.) in which the external diameter of the development roller was modified to 9 mm, and was subjected to following evaluations (1) through (3). On evaluation, image formation was carried out at a linear rate of 280 mm/minute (at approximately 50 sheets per minute). In each evaluation, grades "A" and "B" are acceptable, while grades "C" and "D" are unacceptable, unless otherwise specified.

(1) Color Evaluation of Red Logo Mark

Each of the red logo marks of 50 companies employing red in their logo marks was displayed on the computer display detailed below from a home page of the companies, and was printed on a transfer paper "WASHI COPY DAIO" (produced by OZU Sangyo Corp.). The resulting print was evaluated by 100 panelists randomly selected from persons aged teens to seventies, and the evaluation was carried out based on the number of panelists who evaluated that the color of the logo mark displayed on the display was reproduced on the print in which the color of the logo mark on the print was not different from that on the display. The evaluation criteria were as follows.

(Evaluation Criteria)

A: At least ninety panelists evaluated the color as "reproduced".

B: Eighty to less than ninety panelists evaluated the color as "reproduced".

C: Sixty to less than eighty panelists evaluated the color as "reproduced".

D: Less than sixty panelists evaluated the color as "reproduced".

(Display Conditions of Computer)

Computer: iMac (produced by Apple Computer Co., Ltd.)
24-inch wide screen LCD,
Resolution: 1,920×1,200 pixels
2.16 GHz Intel Core 2 Duo Processor 1
4 MB shared L2 cache,
1 GB memory (2×512 MB SO-DIMM)
250 GB serial ATA hard drive 2
8× double layer system Super Drive (DVD+R DL, DVD±RW, CD-RW)
NVIDIA GeForce 7300 GT 128 MB GDDR3 memory
Air Mac Extreme, and built-in Bluetooth 2.0
Apple Remote (2) Evaluation of Color Reproduction of Citrus Image A total of ten citrus fruits consisting of two of each of the following five kinds of citruses were provided.

Mandarin oranges (or Mandarins),
Unshu mikan (botanical name: *Citrus unsyu* Marc.),
Grape fruit (botanical name: Citrus X paradise),
Non yuzu (botanical name: *Citrus junos*), and
lemon (botanical name: *Citrus limon*)

These were photographed under sunlight, and the resulting ten photographic images were displayed on the above computer display, and were then printed onto a transfer paper "POD GLOSS COAT 128 g/m$^2$" (produced by Oji Paper Co., Ltd.). In the same manner as above, the number of panelists among the 100 panelists, who evaluated that the color of the photographic images on the display was reproduced on the transfer paper in which the color of the photographic images on the print was not different from that on the display, was determined, and the evaluation was carried out based on the following criteria.

(Evaluation Criteria)

A: At least eighty panelists evaluated the color as "reproduced".

B: Sixty-five to less than eighty panelists evaluated the color as "reproduced".

C: Fifty to less than sixty-five panelists evaluated the color as "reproduced".

D: Less than fifty panelists evaluated the color as "reproduced".

(3) Color Evaluation of Blue Logo Mark

Each of the blue logo marks of 50 companies employing blue in their logos was displayed on the computer display from a home page of the companies, in the same manner as the red logo marks above, and was printed on a transfer paper "WASHI COPY DAIO" (produced by OZU Sangyo Corp.). The resulting print was evaluated by 100 panelists randomly selected from persons aged teens to seventies, and the evaluation was carried out based on the number of panelists who evaluated that the color of the logo mark displayed on the display was reproduced on the print in which the color of the logo mark on the print was not different from that on the display. The evaluation criteria were as follows.

(Evaluation Criteria)

A: At least ninety panelists evaluated the color as "reproduced".

B: Eighty to less than ninety panelists evaluated the color as "reproduced".

C: Sixty to less than eighty panelists evaluated the color as "reproduced".

D: Less than sixty panelists evaluated the color as "reproduced".

(4) Evaluation of Color Tone Reproduction of Violet-blue Color Codes

Patch images of seven violet-blue color codes were displayed on the computer display as described above, and images corresponding to the patch images were printed. Whether color tones of the printed images are discriminated was evaluated.

The seven violet-blue color codes used for evaluation ware #7f00ff, #7700et, #7000e0, #6800d1, #6000c1, #5900b2, and #5100a1. Evaluation was carried out according to the following evaluation criteria. Grades "a" and "b" were evaluated as acceptable (Evaluation Criteria)

a: Seven color tones were discriminated.

b: Five to less than seven color tones were discriminated.

c: Less than four color tones were discriminated.

(5) Color Evaluation of Green Logo Marks

Each of the blue logo marks of 50 companies among banks, incorporated schools and makers each employing green in the logo mark was displayed on the computer display from a home page of the companies, in the same manner as the red logo marks above, and was printed on a transfer paper "WASHI COPY DAIO" (produced by OZU Sangyo Corp.). The resulting print was evaluated by 100 panelists randomly selected from persons aged teens to seventies, and the evaluation was carried out based on the number of panelists who evaluated that the color of the logo mark displayed on the display was reproduced on the print in which the color of the logo mark on the print was not different from that on the display. The evaluation criteria were as follows.

(Evaluation Criteria)

A: At least ninety panelists evaluated the color as "reproduced".

B: Eighty to less than ninety panelists evaluated the color as "reproduced".

C: Sixty to less than eighty panelists evaluated the color as "reproduced".

D: Less than sixty panelists evaluated the color as "reproduced".

(6) Evaluation of Color Tone Reproduction of Green Color Codes

Patch images of eight green color codes were displayed on the computer display as described above, and images corresponding to the patch images were printed. Whether color tones of the printed images are discriminated was evaluated.

The eight green color codes used for evaluation ware Yellow Green (#9ACD32), Green Yellow (#ADFF2F), Chartreuse (#7FFF00), Lime (#00FF00), Spring Green (#00FF7F), Mediumu Spring Green (#00FA9A), Lime Green (#32CD32), and Medium Sea Green (#3CB371). Evaluation was carried out according to the following evaluation criteria. Grades "a" and "b" were evaluated as acceptable.

(Evaluation Criteria)

a: Eight color tones were discriminated.

b: Six to less than eight color tones were discriminated.

c: Less than six color tones were discriminated.

(7) Evaluation of Gloss

A yellow solid image, a magenta solid image, and a cyan solid image were printed on a 135 kg paper of the A3 size (heavy paper), each image given a toner coat amount of 4.5 $g/m^2$. Gloss of the initial image of each solid color image was evaluated. Gloss difference was determined employing a commercially available glass meter PG-3G (produced by Nippon Denshoku Industrial Co., Ltd.; incident angle: 75°). Grades "a", "b" and "c" were evaluated as acceptable.

a: Gloss Difference≦6 b: 6<Gloss Difference≦14 c: 14<Gloss Difference≦20 d: 20<Gloss Difference≦14

The results are shown in Table 11.

TABLE 11

| Set Sample No. | Combination of Developers | | |
|---|---|---|---|
| | Yellow Toner No. | Magenta Toner No. | Cyan Toner No. |
| 1 (Inv.) | 1 | 1 | 1 |
| 2 (Inv.) | 2 | 2 | 2 |
| 3 (Inv.) | 3 | 3 | 3 |
| 4 (Inv.) | 4 | 4 | 4 |
| 5 (Inv.) | 5 | 5 | 5 |
| 6 (Inv.) | 6 | 6 | 6 |
| 7 (Inv.) | 7 | 7 | 7 |
| 8 (Inv.) | 9 | 9 | 9 |
| 9 (Inv.) | 10 | 10 | 10 |
| 10 (Inv.) | 11 | 11 | 1 |
| 11 (Inv.) | 12 | 12 | 1 |
| 12 (Inv.) | 13 | 13 | 1 |
| 1 (Comp.) | 17 | 17 | 1 |
| 2 (Comp.) | 8 | 8 | 8 |
| 3 (Comp.) | 14 | 14 | 13 |
| 4 (Comp.) | 15 | 15 | 1 |
| 5 (Comp.) | 16 | 16 | 12 |
| 6 (Comp.) | 18 | 1 | 1 |
| 7 (Comp.) | 19 | 1 | 1 |
| 8 (Comp.) | 20 | 1 | 1 |
| 9 (Comp.) | 21 | 1 | 1 |
| 10 (Comp.) | 22 | 18 | 1 |
| 11 (Comp.) | 23 | 19 | 1 |
| 12 (Comp.) | 24 | 20 | 1 |
| 13 (Comp.) | 25 | 1 | 1 |

TABLE 11-continued

| Set Sample | Evaluation of Image Quality | | | | | | |
|---|---|---|---|---|---|---|---|
| No. | (i) | (ii) | (iii) | (iv) | (v) | (vi) | (vii) |
| 1 (Inv.) | A | A | A | 7 Colors | A | 8 Colors | 2.1 |
| 2 (Inv.) | A | B | A | 6 Colors | A | 8 Colors | 4.2 |
| 3 (Inv.) | A | B | A | 6 Colors | A | 8 Colors | 5.3 |
| 4 (Inv.) | A | B | A | 5 Colors | A | 7 Colors | 7.5 |
| 5 (Inv.) | A | B | A | 5 Colors | A | 7 Colors | 6.9 |
| 6 (Inv.) | A | B | A | 5 Colors | A | 7 Colors | 7.1 |
| 7 (Inv.) | A | B | A | 5 Colors | A | 7 Colors | 8.6 |
| 8 (Inv.) | A | B | A | 5 Colors | A | 7 Colors | 12.0 |
| 9 (Inv.) | B | B | B | 5 Colors | A | 7 Colors | 12.5 |
| 10 (Inv.) | B | B | B | 5 Colors | A | 7 Colors | 12.4 |
| 11 (Inv.) | B | B | B | 5 Colors | A | 7 Colors | 14.5 |
| 12 (Inv.) | B | B | B | 5 Colors | A | 7 Colors | 11.2 |
| 1 (Comp.) | A | A | C | 5 Colors | C | 6 Colors | 15.4 |
| 2 (Comp.) | A | B | D | 4 Colors | B | 5 Colors | 15.5 |
| 3 (Comp.) | B | B | D | 5 Colors | D | 4 Colors | 16.8 |
| 4 (Comp.) | B | B | D | 4 Colors | B | 5 Colors | 17.5 |
| 5 (Comp.) | A | A | D | 4 Colors | D | 5 Colors | 13.5 |
| 6 (Comp.) | A | A | B | 5 Colors | C | 5 Colors | 17.4 |
| 7 (Comp.) | A | A | B | 5 Colors | C | 5 Colors | 16.8 |
| 8 (Comp.) | B | B | B | 5 Colors | C | 5 Colors | 17.6 |
| 9 (Comp.) | D | D | B | 5 Colors | C | 5 Colors | 15.9 |
| 10 (Comp.) | D | D | C | 4 Colors | B | 8 Colors | 21.1 |
| 11 (Comp.) | D | D | C | 4 Colors | B | 8 Colors | 22.2 |
| 12 (Comp.) | D | D | C | 4 Colors | B | 8 Colors | 23.5 |
| 13 (Comp.) | D | D | B | 5 Colors | D | 5 Colors | 16.6 |

Inv.: Inventive,
Comp.: Comparative
(i) Color Reproduction of Red Logos
(ii) Color Reproduction of Citrus Images
(iii) Color Reproduction of Blue Logos
(iv) Reproduction of Violet-blue Color Codes
(v) Color Reproduction of Green Logos
(vi) Reproduction of Green Color Codes
(vii) Gloss Difference As is apparent from Table 11, Inventive set samples 1 through 12, which satisfy the claimed scope, provide excellent results. On the other hand, Comparative set samples 1 through 1, which do not satisfy the claimed scope, provide unacceptable color tone. It has proved that there is remarkable deference in color tone between samples satisfying the claimed scope and those not satisfying the claimed scope.

What is claimed is:

1. A process of forming a full color image according to electrophotography, employing at least a yellow toner being particles having a core-shell structure which is composed of a shell comprised of a shell resin having a glass transition temperature (Tg) in the range of from 38 to 64° C., and covered therewith, a core comprised of a yellow colorant and a core resin having a glass transition temperature (Tg) in the range of from 10 to 50° C., a magenta toner being particles having a core-shell structure which is composed of a shell comprised of a shell resin having a glass transition temperature (Tg) in the range of from 38 to 64° C., and covered therewith, a core comprised of a magenta colorant and a core resin having a glass transition temperature (Tg) in the range of from 10 to 50° C.; and a cyan toner being particles having a core-shell structure which is composed of a shell comprised of a shell resin having a glass transition temperature (Tg) in the range of from 38 to 64° C., and covered therewith, a core comprised of a cyan colorant and a core resin having a glass transition temperature (Tg) in the range of from 10 to 50° C.;

the yellow colorant comprising a mixture of a first yellow colorant and a second yellow colorant, wherein the first yellow colorant is selected from the group X consisting of C.I. Pigment Yellow 3, C.I. Pigment Yellow 35, C.I. Pigment Yellow 65, C.I. Pigment Yellow 74, C.I. Pigment Yellow 98 and C.I. Pigment Yellow 111, the second yellow colorant is selected from the group Y consisting of C.I. Pigment Yellow 9, C.I. Pigment Yellow 36, C.I. Pigment Yellow 83, C.I: Pigment Yellow 110, C.I. Pigment Yellow 139, C.I. Pigment Yellow 181 and C.I. Pigment Yellow 153, and the content ratio by weight of the first colorant to the second pigment in the yellow toner is from 65:35 to 95:5;

the magenta colorant comprising a mixture of a pigment or a dye with a complex, wherein the pigment is selected from the group consisting of C.I. Pigment Red 2, 3, 6, 7, 9, 15, 16, 48:1, 48:3, 53:1, 57:1, 122, 123, 139, 144, 149, 166, 177, 178, 208, 209, and 222, the dye is selected from the group consisting of C.I. Solvent Red 3, 14, 17, 18, 22, 23, 49, 51, 53, 87, 127, 128, 131, 145, 146, 149, 150, 151, 152, 153, 154, 155, 156, 157, 158, 176 and 179, and the complex is selected from the group consisting of complexes 1, 2, 3 and 4 shown below, Complex 1

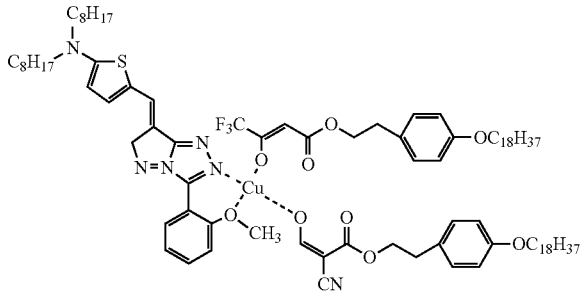

Complex 2

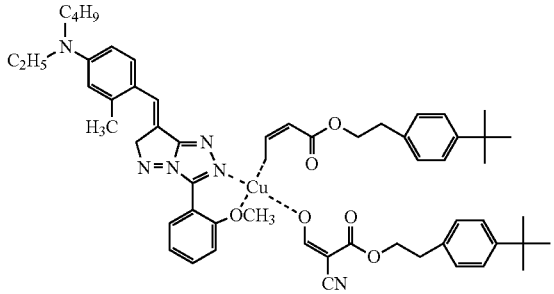

Complex 3

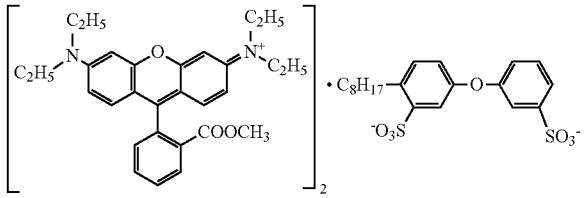

Complex 4

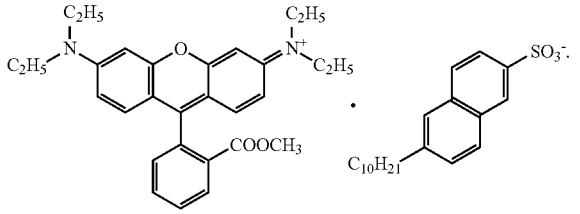

the cyan colorant comprising a silicon phthalocyanine compound represented by the following formula (I), Formula (I)

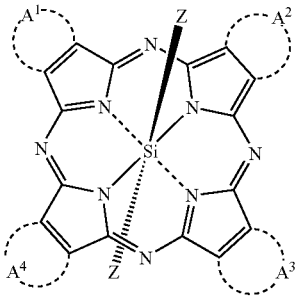

wherein Z represents a group represented by formula (IV) below,

Formula (IV)

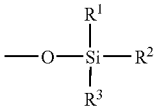

in which $R^1$, $R^2$ and $R^3$ independently represent an alkyl group with a carbon atom number of from 1 to 6, provided that $R^1$, $R^2$ and $R^3$ may be the same or different; and $A^1$, $A^2$, $A^3$, and $A^4$ represent an unsubstituted benzene ring;

the process comprising the step of forming a yellow toner, image, a magenta toner image and a cyan toner image on a recording material, wherein the yellow toner image has reflectance (in terms of %) satisfying formulas (11) through (14) below, the magenta toner image has reflectance (in terms of %) satisfying formulas (21) through (24) below, and the cyan toner image has reflectance (in terms of %) satisfying formulas (31) through (34) below, $$2 \leqq A_{415}+A_{460} \leqq 24 \quad \text{Formula (11)}$$

wherein $A_{415}$ and $A_{460}$ represent reflectance (in terms of %) at a wavelength of 415 nm and reflectance (in terms of %) at a wavelength of 460 nm, respectively, $$20 \leqq A_{510}-A_{490} \leqq 40 \quad \text{Formula (12)}$$

wherein $A_{510}$ and $A_{490}$ represent reflectance (in terms of %) at a wavelength of 510 nm and reflectance (in terms of %) at a wavelength of 490 nm, respectively, $$2 \leqq A_{550}-A_{530} \leqq 16 \quad \text{Formula (13)}$$

$$70 \leqq A_{550} \quad \text{Formula (14)}$$

wherein $A_{550}$ and $A_{530}$ represent reflectance (in terms of %) at a wavelength of 550 nm and reflectance (in terms of %) at a wavelength of 530 nm, respectively;

$$30 \leqq B_{450}-B_{520} \leqq 85 \quad \text{Formula (21)}$$

wherein $B_{450}$ and $B_{520}$ represent reflectance (in terms of %) at a wavelength of 450 nm and reflectance (in terms of %) at a wavelength of 520 nm, respectively, $$1 \leqq B_{530}+B_{570} \leqq 25 \quad \text{Formula (22)}$$

wherein $B_{530}$ and $B_{570}$ represent reflectance (in terms of %) at a wavelength of 530 nm and reflectance (in terms of %) at a wavelength of 570 nm, respectively, $$2 \leqq B_{670}-B_{600} \leqq 50 \quad \text{Formula (23)}$$

$$80 \leqq B_{670} \quad \text{Formula (24)}$$

wherein $B_{670}$ and $B_{600}$ represent reflectance (in terms of %) at a wavelength of 670 nm and reflectance (in terms of %) at a wavelength of 600 nm, respectively; and $$4 \leqq |C_{480}-C_{450}| \leqq 16 \quad \text{Formula (31)}$$

wherein $C_{480}$ and $C_{450}$ represent reflectance (in terms of %) at a wavelength of 480 nm and reflectance (in terms of %) at a wavelength of 450 nm, respectively, $$15 \leqq C_{550}-C_{570} \leqq 35 \quad \text{Formula (32)}$$

$$20 \leqq C_{570} \leqq 50 \quad \text{Formula (33)}$$

wherein $C_{550}$ and $C_{570}$ represent reflectance (in terms of %) at a wavelength of 550 nm and reflectance (in terms of %) at a wavelength of 570 nm, respectively, $$1 \leqq C_{620}+C_{650} \leqq 30 \quad \text{Formula (34)}$$

wherein $C_{620}$ and $C_{650}$ represent reflectance (in terms of %) at a wavelength of 620 nm and reflectance (in terms of %) at a wavelength of 650 nm, respectively.

2. The process of claim 1, wherein the yellow toner image further has a reflectance at a wavelength of 415 nm reflectance $A_{415}$ of from 7 to 12% and a reflectance at a wavelength of 570 nm reflectance $A_{570}$ of from 75 to 85%.

3. The process of claim 1, wherein the total content of the first yellow colorant and the second yellow colorant in the yellow toner is from 2 to 12 parts by weight, based on 100 parts by weight of the yellow toner.

4. The process of claim 1, wherein the softening point of the yellow toner, the magenta toner and the cyan toner is from 75 to 112° C.

5. The process of claim 1, wherein the glass transition temperature (Tg) of the core resin is preferably lower than that of the shell resin.

6. The process of claim 1, wherein the core resin is a copolymer having therein a monomer unit selected from the group consisting of propyl acrylate, propyl methacrylate, butyl acrylate, butyl methacrylate, 2-ethylhexyl acrylate and 2-ethylhexyl methacrylate, and the shell resin is a copolymer having therein a monomer unit selected from the group consisting of styrene, methyl methacrylate and methacrylic acid.

7. The process of claim 1, wherein the yellow toner, the magenta toner and the cyan toner are particles having a volume-based median diameter of from 3 to 8 μm.

8. The process of claim 1, wherein the cyan colorant further comprises a compound represented by the following formula (II), Formula (II)

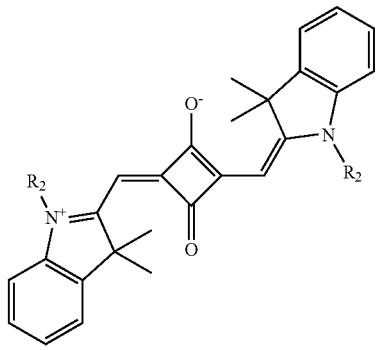

wherein $R_2$ represents a hydrogen atom or an organic group.

9. The process of claim 1, wherein the resin content of the yellow toner, the resin content of the magenta toner and the resin content of the cyan toner are from 60 to 95% by weight.

* * * * *